US006751406B2

(12) United States Patent
Reiker

(10) Patent No.: US 6,751,406 B2
(45) **Date of Patent: *Jun. 15, 2004**

(54) CEILING MOUNTED HEATING DEVICE AND METHOD THEREFOR

(75) Inventor: Kenneth H. Reiker, Shalimar, FL (US)

(73) Assignee: Reiker Room Conditioners, LLC, Shalimar, FL (US)

( * ) Notice: Subject to any disclaimer, the term of this patent is extended or adjusted under 35 U.S.C. 154(b) by 37 days.

This patent is subject to a terminal disclaimer.

(21) Appl. No.: 10/087,694

(22) Filed: Mar. 1, 2002

(65) Prior Publication Data

US 2002/0081107 A1 Jun. 27, 2002

Related U.S. Application Data

(63) Continuation-in-part of application No. 10/021,131, filed on Oct. 22, 2001, application No. 10/087,694, which is a continuation-in-part of application No. 09/805,478, filed on Mar. 13, 2001, which is a continuation of application No. 09/443,617, filed on Nov. 19, 1999, now Pat. No. 6,240,247, which is a continuation-in-part of application No. 09/439,763, filed on Nov. 15, 1999, application No. 10/087,694, which is a continuation-in-part of application No. 09/598,855, filed on Jun. 21, 2000, now Pat. No. 6,366,733.

(60) Provisional application No. 60/141,499, filed on Jun. 28, 1999, provisional application No. 60/262,491, filed on Jan. 17, 2001, provisional application No. 60/141,499, filed on Jun. 28, 1999, and provisional application No. 60/108,686, filed on Nov. 16, 1998.

(51) Int. Cl.[7] ..... F24H 3/00
(52) U.S. Cl. ..... 392/364; 416/5
(58) Field of Search ..... 392/360–369, 392/384, 385; 416/5, 95, 120; 165/122, 125, 59

(56) References Cited

U.S. PATENT DOCUMENTS

| | | | | |
|---|---|---|---|---|
| 449,404 | A | | 3/1891 | Dewey |
| 2,359,021 | A | | 9/1944 | Campbell et al. |
| 2,504,798 | A | | 4/1950 | Brinen |
| 3,223,828 | A | | 12/1965 | Mast |
| 3,458,739 | A | | 7/1969 | Zelinski et al. |
| 3,612,168 | A | | 10/1971 | Peterson |
| 4,013,083 | A | * | 3/1977 | Helbling ..... 132/271 |
| 4,508,958 | A | | 4/1985 | Kan et al. |
| 4,694,142 | A | | 9/1987 | Glucksman |
| 4,782,213 | A | | 11/1988 | Teal |
| D320,439 | S | | 10/1991 | Harper |
| 5,077,825 | A | | 12/1991 | Monrose |

(List continued on next page.)

FOREIGN PATENT DOCUMENTS

| | | | |
|---|---|---|---|
| AU | 9914223 | * | 7/2000 |
| DE | 3814612 A | | 11/1989 |
| GB | 865167 | | 11/1958 |
| JP | 401123949 A2 | | 5/1989 |
| WO | WO 01/01047 A1 | | 1/2001 |

OTHER PUBLICATIONS

Casablanca Fan Co., "The Fan Book", Reston Publishing Co., 1983, pp. 3–128.

Pelonis, "Pelonis USA", <<www.pelonis.com>>, Pelonis USA, Ltd., 2000, 7 pages.

*Primary Examiner*—John A. Jeffery
(74) *Attorney, Agent, or Firm*—Myers & Kaplan, LLC; Joel D. Myers; Ashish D. Patel

(57) ABSTRACT

A method, system and apparatus for heating a room, wherein at least one motor and at least one fan blade of a Ceiling Mounted Heating Device, mounted upwards of a distribution fan, moves air into said device through one or more inlets and is forced through and heated by one or more heating elements. The heated air is discharged as a heated primary airflow through one or more outlets, wherein the primary heated airflow mixes with the airflow created by the distribution fan, thus creating distribution of heated airflow throughout a room.

102 Claims, 38 Drawing Sheets

U.S. PATENT DOCUMENTS

| | | | | | |
|---|---|---|---|---|---|
| D327,315 | S | | 6/1992 | Pelonis | |
| 5,133,042 | A | | 7/1992 | Pelonis | |
| 5,259,062 | A | | 11/1993 | Pelonis | |
| 5,333,235 | A | | 7/1994 | Ryder | |
| D358,873 | S | | 5/1995 | Pelonis | |
| 5,425,126 | A | | 6/1995 | Lee | |
| 5,489,191 | A | | 2/1996 | Tai | |
| 5,528,229 | A | * | 6/1996 | Mehta | 165/247 |
| D381,074 | S | | 7/1997 | Pelonis | |
| 5,668,920 | A | | 9/1997 | Pelonis | |
| D404,123 | S | | 1/1999 | Pelonis | |
| 5,887,785 | A | | 3/1999 | Yilmaz | |
| D423,661 | S | | 4/2000 | Pelonis | |
| 6,160,956 | A | | 12/2000 | Pelonis | |
| 6,167,193 | A | * | 12/2000 | Birdsell et al. | 392/365 |
| 6,240,247 | B1 | | 5/2001 | Reiker | |
| 6,244,820 | B1 | | 6/2001 | Yilmaz | |
| 6,366,733 | B1 | | 4/2002 | Reiker | |
| 6,438,322 | B1 | | 8/2002 | Reiker | |
| 6,477,321 | B2 | * | 11/2002 | Reiker | 392/364 |
| 6,631,243 | B2 | * | 10/2003 | Reiker | 392/364 |
| 2002/0064380 | A1 | * | 5/2002 | Reiker | 392/364 |
| 2003/0228142 | A1 | * | 12/2003 | Reiker | 392/364 |

* cited by examiner

CEILING MOUNTED HEATING DEVICE AND METHOD THEREFOR

CROSS-REFERENCE AND PRIORITY CLAIM TO RELATED APPLICATIONS

To the full extent permitted by law, the present application claims priority to and the benefit of the following applications: (1) as continuation-in-part application of non-provisional application entitled "Air Recirculating and Heating Device", filed Oct. 22, 2001 having assigned Ser. No. 10/021,131 which claims benefit of provisional patent application entitled "Room Conditioner With Coaxial Fan And Heater Modules", filed on Jan. 17, 2001, having assigned Serial No. 60/262,491; 2) as a continuation-in-part application of non-provisional application entitled "Ceiling Fan Room Conditioner With Ceiling Fan And Heater", filed Mar. 13, 2001, having assigned Ser. No. 09/805,478 which is a continuation of and claims priority to and benefit of non-provisional application entitled "Room Conditioner With Ceiling Mounted Heater", filed Nov. 19, 1999, having assigned Ser. No. 09/443,617 and having now issued as U.S. Pat. No. 6,240,247, which is a continuation-in-part of and claims priority to and benefit of non-provisional application entitled "Ceiling Fan With Attached Heater and Secondary Fan" filed on Nov. 15, 1999, having assigned Ser. No. 09/439,763 which claims priority to provisional application entitled "Stabilized Air Temperature Distribution Apparatus", filed on Nov. 16, 1998, having assigned Serial No. 60/108,686; 3) as a continuation-in-part application of non-provisional application entitled "Ceiling Fan With Attached Heater and Secondary Fan" filed on Nov. 15, 1999, having assigned Ser. No. 09/439,763 which claims priority to and the benefit of provisional application entitled "Stabilized Air Temperature Distribution Apparatus", filed on Nov. 16, 1998, having assigned Ser. No. 60/108,686; and 4) as a continuation-in-part application of non-provisional application entitled "Ceiling Fan Having One Or More Fan Heaters" filed on Jun. 21, 2000, having assigned Ser. No. 09/598now U.S. Pat. No. 6,366,733, which claims priority to and the benefit of provisional application entitled "Ceiling Fan Having Dual Fan Heaters", filed on Jun. 28, 1999, having assigned Serial. No. 60/141,499, wherein all above applications are incorporated herein by reference.

BACKGROUND OF THE INVENTION

1. Field of the Invention

The present invention relates to an apparatus, system and method for heating a room, and more specifically to a ceiling mounted heating device that creates a primary heated airflow preferably via an impeller that moves air from an upward location in a room and thereafter across heating elements. The ceiling mounted heating device is preferably adapted to an upward location and is designed to work in an integrated fashion with a ceiling fan, wherein operation of the ceiling fan will create a secondary airflow for distributing the primary heated airflow throughout a room.

2. Description of Related Art

Prior art systems for heating dwellings and offices were primarily by use of radiators having heated water flowing therethrough. Such heating was essentially practical only in buildings wherein a common boiler for heating water was practical. Dispersion of heat from the radiators was primarily a function of convective airflow that unfortunately left vestigial cold and hot spots within the room. Moreover, use of such radiators typically imposed a constraint on furniture arrangement and caused related impediments.

In many private dwellings and offices, forced air systems are currently utilized, as they are relatively inexpensive to install. However, in view of heat loss through ductwork and the size of the heating unit necessary to bring sufficient heat to a multitude of respective rooms, such forced air systems are usually quite expensive to operate. Furthermore, duct outlets, whether wall, floor or ceiling mounted, tend to constrict furniture arrangement as well, often producing hot and cold spots within a room. Moreover, electrically operated baseboard heaters typically rely upon convection for dispersion of heated air, resulting in inadequate heat distribution, production of hot and cold spots, and constraint of furniture placement and activities within a room.

Ceiling fans having heaters suspended therefrom have also been attempted. These heaters usually include a fan or the like for directing air heated by an electric heating element into the path of airflow produced by the ceiling fan. The downward direction of airflow produced by the ceiling fan results in the creation of a hot spot beneath the ceiling fan and a significant temperature gradient from the center of a room to its perimeter. The resulting hot and cold spots are generally uncomfortable and unacceptable as furniture placement limitations are imposed.

Ceiling fans drawing heated air upwardly from a below mounted heater are also known. However, such ceiling fans are of little practical value since the fan motor tends to overheat and self-destruct relatively quickly. Another major factor contributing to the loss of efficiency has been the previous inability of ceiling fans to comfortably remove trapped warm air from the ceiling. As such, in addition to the small temperature gradient within the room, the occupant is quickly subjected to uncomfortable drafts from a ceiling fan alone. In addition to the failure of previous heating units to properly mix the required upward movement of air from the ceiling fan with an additional heated air source, cool airflow from off the blades of a stand-alone ceiling fan is typically greater than the warm air it pushes off the ceiling, thus leaving the occupant feeling uncomfortable.

More specifically, examples of ceiling fans having heaters suspended therefrom may be found by reference to U.S. Pat. No. 4,508,958 to Kan et al., U.S. Pat. No. 5,668,920 to Pelonis, U.S. Pat. No. 5,887,785 to Yilmaz and U.S. Pat. No. 4,694,142 to Glucksman. However, in light of the present invention, the aforementioned designs are deficient in that they either fail to evenly distribute heated air throughout the room and thus result in cold spots and hot spots, or they fail to protect the fan motors from adverse heat generated from improperly isolated heating elements and/or deficient airflow design.

For instance, Kan et al. discloses a ceiling fan with adjacently mounted heating elements on the primary fan motor. Such proximity of the heating elements usually results in the adverse overheating of the fan motor and its consequential destruction. The Kan et al. patent fails to employ a heat sink barrier and therefore subjects the rotor and stator of the primary fan motor to nonisolated heat conditions. Further, the Kan et al. design and positioning of the secondary fan blades from the rotor hinders adequate air supply, thus yielding poor distribution of heated air and unwanted cold spots and hot spots throughout the room.

The Pelonis and Yilmaz patents disclose ceiling fans containing both a ceiling fan motor and a heater fan motor. However, due to the design of the Pelonis and Yilmaz inventions, both inventions fail to ensure isolation of the heating elements from the fan motors, thereby causing the subsequent overheating and malfunction of the same.

Further, the design of the Pelonis invention essentially amounts to the fan motor blowing heated air in a directly downward fashion instead of an ideal circulating fashion, leaving unwanted cold spots throughout the room.

The Glucksman patent discloses an axial fan in coaxial alignment with an electric resistance heater. The Glucksman invention possesses not only the main elements of a space heater, but also the inadequacies and inefficiencies associated therewith. More specifically, the Glucksman design fails to uniformly distribute its produced heated air throughout a room. Therefore, the inherent deficiency therefore in the Glucksman design yields intense and uncomfortable hot air adjacent to the space heater and uncomfortable and unwanted cold air/spots in areas removed from the space heater.

An additional deficiency in the above references is that many of the ceiling fan/heater devices fail to disclose an adequate means for obtaining and controlling a desired temperature at various elevations. More specifically, with prior systems, the temperature at a standard standing height can often be several degrees higher than at the floor level. Unfortunately, wall-mounted thermostats are often mounted at the standard standing height level and only accurately reflect the temperature at that level. As such, if the occupants are sitting on the floor or on a sofa, the wall-mounted thermostat does not reflect the desired temperature at that level. Moreover, manually operated controls typically require constant manual adjustments depending on the occupant's elevation.

Therefore, it is readily apparent that a new and improved ceiling mounted heating device is needed, wherein the device provides a means for having a ceiling fan attached thereto and further provides a consistent and adequate uniform distribution of heated air without subjecting the fan motors to adverse heat elevations, and wherein any desired temperature at any desired elevation may be easily obtained. It is, therefore, to the provision of such an improvement that the present invention is directed.

SUMMARY OF THE INVENTION

Briefly described, in a preferred embodiment, the present invention overcomes the above-mentioned disadvantages, and meets the recognized need for such a device by providing a highly efficient preferably ceiling mounted heating device designed to achieve desired heating and energy objectives by creating a powerful, heated airflow using as little energy as possible. The heating device is constructed in such a manner that allows it to integrate with a ceiling fan in either a load-bearing or non load-bearing configuration. Located preferably inside the heating device is preferably an impeller having a blade or blades thereon, heating elements and heat sink material for protecting proximate components from unacceptable heat transfer from the heating elements.

The heating device is designed to move air from an upward location, preferably adjacent the ceiling, by preferably energizing the impeller. Heat is then added to the moved air by the impeller urging the moved air through heating elements before exhausting the now primary heated airflow through outlets. The heating device is able to achieve its greatest efficiency through the constant recycling of heated air molecules, thus reducing the rest and subsequent dissipation of the heated air molecules along the ceiling. Further, the heating device continuously reenergizes the air molecules and circulates them throughout the room with a ceiling fan. A ceiling fan may also be adapted to the heating device, thus creating a system that uniformly distributes primary heated airflow throughout a room.

As the temperature of a room reaches its desired comfort level, preferably a remote transmitter/receiver supplied with the invention reduces the amount of energy needed to maintain the room temperature by reducing the number of heating elements activated and/or the energy consumed by the heating elements. Contrary to conventional systems, the heating device continuously reinvigorates previously heated air molecules with additional heat. The device is designed to first achieve a desired temperature setting and then to maintain that setting with the least amount of energy necessary.

The invention is designed to mount upwards of a ceiling fan in optimum configuration for preferably mixing the primary heated airflow created by the device with the secondary airflow created by the ceiling fan.

A feature and advantage of the present invention is its ability to provide a more efficient method of heating a room than with conventional systems. The invention is an apparatus that will work without ductwork, wherein such ductwork has been proven to loose 30 to 40% of its efficiency through placement in a cold attic and through pressure loss due to lengthy distances from a conventional heating source.

A feature and advantage of the present invention is its ability to provide a method of heating only specified rooms or areas within a home or office. By using such a method, the occupant can regulate the temperature of each room rather than attempting to regulate an entire home with a conventional centrally mounted thermostat. Additionally, due to the rapid response and efficiency provided by the device, only those rooms in use need to be heated, while those not in use, can be closed off and heated just prior to their intended use and/or occupation.

A feature and advantage of the present invention is its ability to provide an adaptive means to integrate a ceiling fan to form a system that provides a method that first creates a primary heated airflow and then distributes it throughout a room for heating.

A f feature and advantage of the present invention is its ability to provide a heating device that when combined with a ceiling fan, will not pass adverse heat created by heating elements within the device to the ceiling fan and adversely impact the ceiling fan's reliability and function.

A feature and advantage of the present invention is its ability to provide a method wherein each cycle of the device further stimulates heated air molecules, causing them to retain additional heat.

A feature and advantage of the present invention is its ability to provide a method of continual stimulation of the heated air molecules for distribution throughout a room that when combined with a conventional ceiling fan, results in large eddies of air colliding and transferring their heated energy to achieve near uniform room temperatures.

A feature and advantage of the present invention is its ability to be mounted in a location that will not encumber or interfere with furnishing and/or furnishing arrangements.

A feature and advantage of the present invention is its ability to provide a heating module portion of an air recirculating and heating system for producing a heated airflow for dispersion by a ceiling fan in a nearly uniform fashion throughout a room and to further maintain the air in the room at a preset desired temperature under control of either an automatic or a manual control unit.

A feature and advantage of the present invention is its ability to provide a ceiling mounted heating device that can be mounted independently of a ceiling fan yet still provide a heated airflow to mix with the airflow inherently created by a moving ceiling fan.

A feature and advantage of the present invention is its ability to provide a heating device adapted to removably receive and secure a conventional ceiling fan and work in association therewith.

These and other objects, features and advantages of the present invention will become apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing figures in which like reference numerals denote similar structures and refer like elements throughout, and in which.

DETAILED DESCRIPTION OF THE PREFERRED EMBODIMENT

In describing the preferred and various alternate embodiments of the present invention, as illustrated in the Figures and/or described herein, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
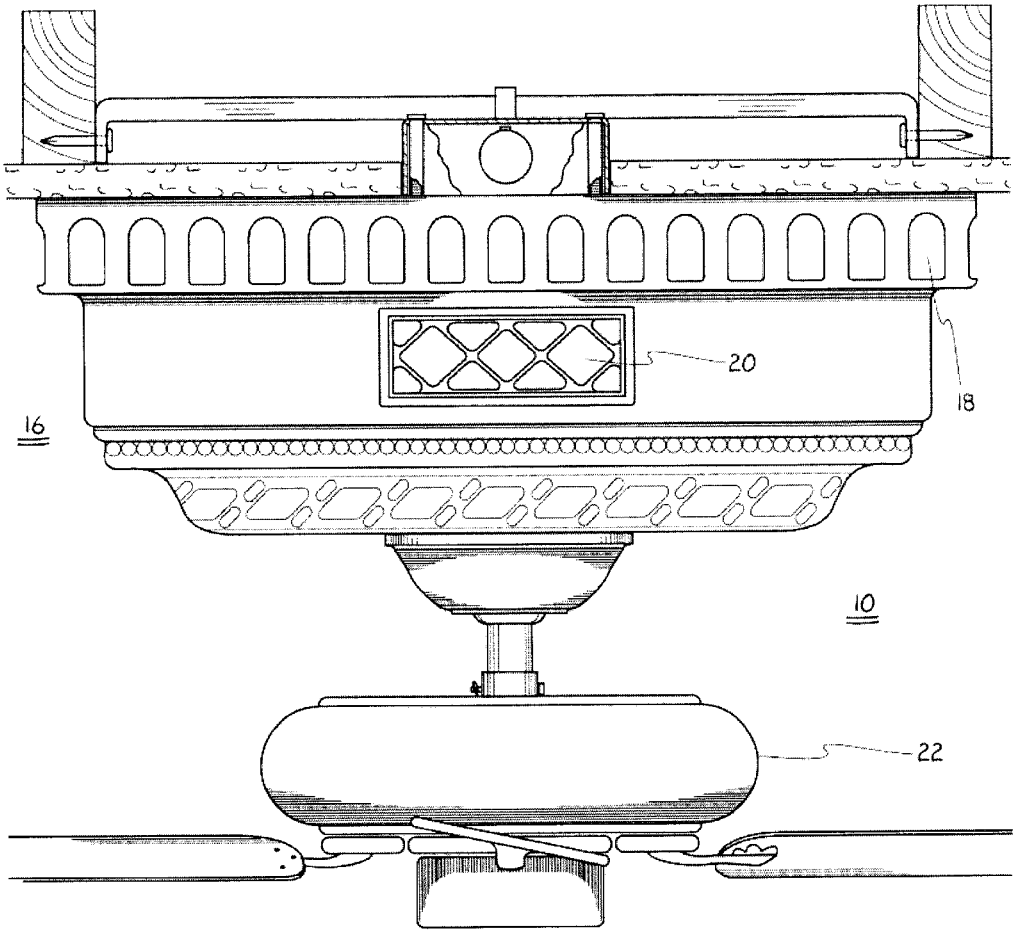
FIG. 1 is a side view of a ceiling mounted heating device according to a preferred embodiment of the present invention showing the device housed within one of several optional decorative housings.

Referring now to FIG. 1, there is illustrated a preferred ceiling mounted heating device 10 enclosed within optional decorative elements or housings. It is to be understood that the exterior configuration illustrated is simply one of a multitude of decorative exterior configurations that may be utilized. Device 10 is preferably adapted from an upward location within a room, such as the ceiling of the room. Device 10 further comprises a preferred heating module 16, wherein heating module 16 has preferred inlets 18 and preferred outlets 20 disposed thereabout. Inlets 18 and outlets 20 preferably define the path of a primary airflow path for heated air as a function of the amount of heating to be performed. An adapted ceiling fan 22 produces a secondary airflow, Pal wherein secondary airflow is directed preferably upward during a heating phase and preferably downward during a cooling phase.

Figure 1A:
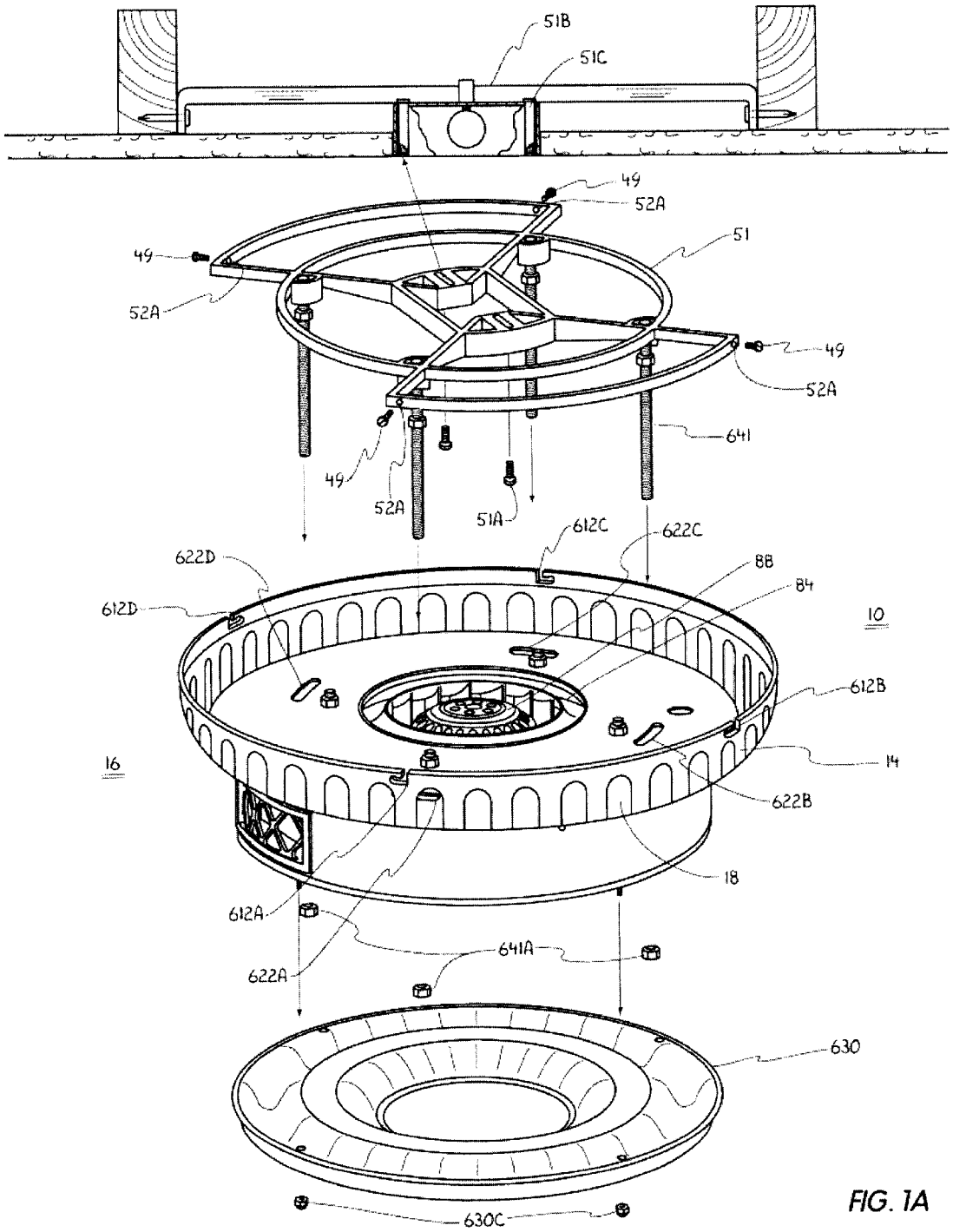
FIG. 1A is a partially exploded view of a ceiling mounted heating device according to a preferred embodiment of the present invention.

FIG. 1A details the components of device 10 in its preassembled exploded configuration, including support means 51, heating module 16 and decorative cover 630. Also shown is preferred ceiling fan brace 51B and electrical box mounting locations 51C.

Figure 2:
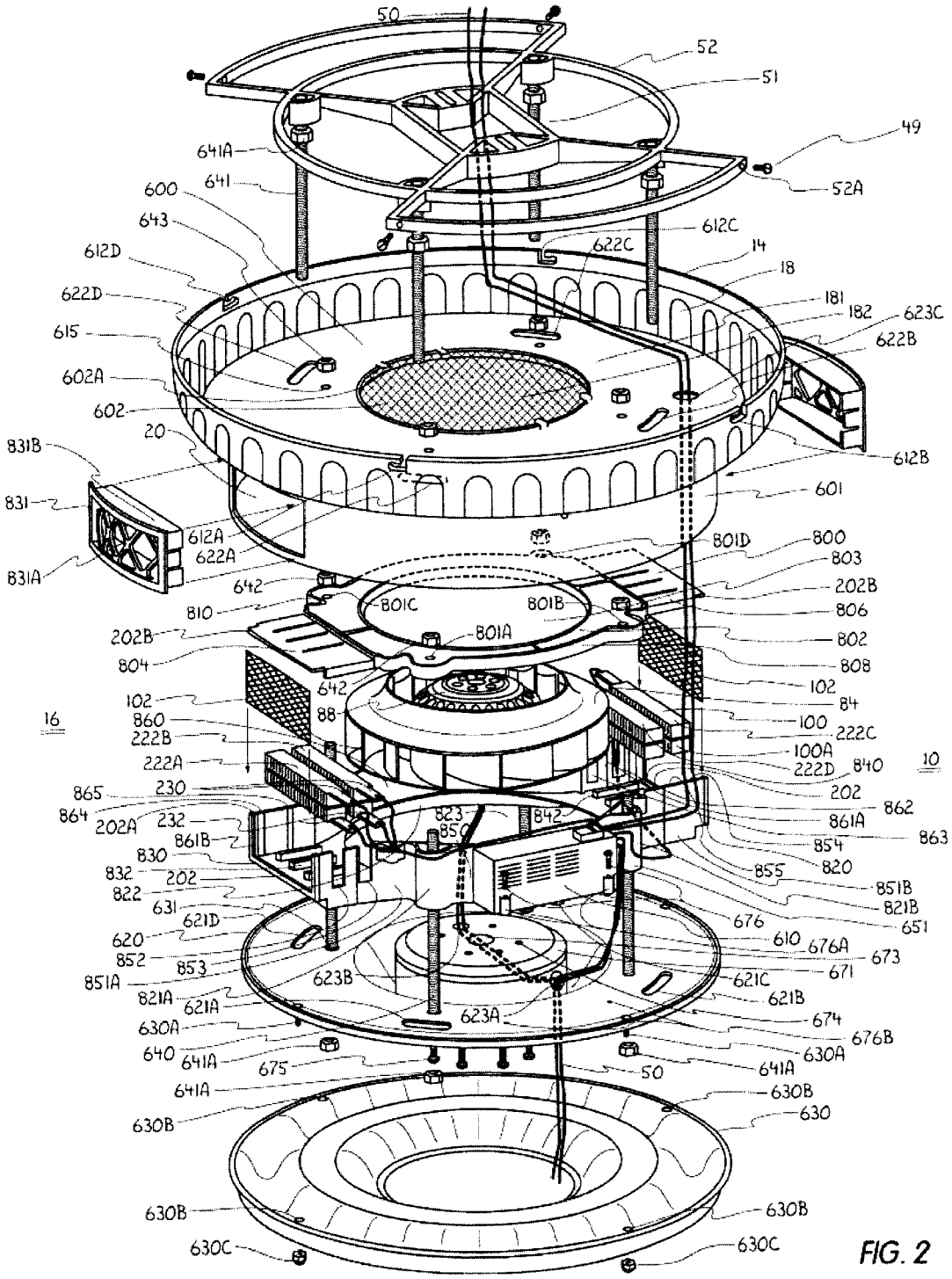
FIG. 2 is a fully exploded view of a ceiling mounted heating device according to a preferred embodiment of the present invention.

The presently preferred, embodiment of device 10 is illustrated in disassembled exploded configuration in FIG. 2. A preferred support means 51 comprises a preferred bracket 52 preferably attached to a conventional electrical box (not shown) or ceiling fan brace 51B and further attached to a joist in the ceiling or similar support member. A plurality of electrical conductors 50 are preferably electrically connected to a source of power within the ceiling and channeled through support means 51 and through the length of device 10 so as to provide power to the various electrical components of device 10. A preferably circular-shaped inlet support ring 14 is attached to bracket 52 preferably via insertion of preferred screws 49 into preferred slots 612A, 612B, 612C and 612D formed around the upper periphery of inlet support ring 14, and thereafter through preferred throughholes 52A formed on bracket 52.

Heating module 16 preferably generally comprises preferred inlet support ring 14, preferred lower support plate 620, preferred upper heat shield 800, preferred lower heat shield 820, preferred motor 88, preferred impeller 84 and preferred heating elements 100. Inlet support ring 14 further preferably has a recessed upper support plate section 181, wherein upper support plate section 181 has a preferred aperture 182 for directing air to impeller 84. Covering preferred aperture 182 is preferably filter 602 for filtering air prior to passing through impeller 84, wherein filter 602 is secured over aperture 182 via tabs 602A. Upper support plate section 181 further preferably has throughhole 623C formed therethrough, wherein throughhole 623C preferably functions to allow the passage of electrical conductors therethrough.

Lower support plate 620 serves preferably as the lower support structure for heating module 16 and as a mounting location for ceiling fan 22. Lower support plate 620 is preferably circular shaped and has a preferably centrally located preferred mounting section 671, wherein mounting section 671 further has a preferred aperture 673 preferably centrally positioned thereon and dimensioned for receiving the lower mounting location of motor 88 of impeller 84. Preferably radially positioned around aperture 673 is a plurality of throughholes 674 for preferably attaching motor 88 and impeller 84 to mounting section 671 via preferred screws 675. Extending around mounting section 671 are preferably four equally spaced preferred throughholes 631 that are dimensioned to preferably each receive one of four preferred threaded posts 640, wherein threaded posts 640 function to secure all components of heating module 16 together. Lower support plate 620 further comprises preferably four preferred throughholes 621A, 621B, 621C and 621D for accepting threaded posts 641, wherein threaded posts 641 are attached to support means 51 by threaded engagement and locked in place by nuts 641A after first passing through preferred throughholes 622A, 622B, 622C and 622D of upper support plate section 181, thereby securing heating module 16 to support means 51. Mounting section 671 also has preferred throughholes 623A and 623B formed thereon for channeling therethrough electrical conductors 50 to various electrical components of device 10.

Positioned on and adapted to lower support plate 620 is preferred lower heat shield 820, wherein lower heat shield 820 comprises a generally circular shaped preferred body 822 having preferably two opposing substantially rectangular preferred planks 830 and 840 attached thereto. Body 822 preferably has a preferred aperture 823 centrally formed therethrough to permit contact between mounting section 671 of lower support plate 620 with motor 88 and impeller 84 and for attachment thereto via attaching screws 675. Extending around the periphery of body 822 and planks 830 and 840 are preferred walls 850 and 860, wherein wall 850 further comprises integrally formed preferred channels 821A and 821B and wall 860 further comprises integrally formed preferred channels 821C and 821D. Channels 821A–821D are dimensioned to receive threaded posts 640 when heating module 16, and device 10 in general, is being assembled.

A preferred wall portion 851A of wall 850 proximal to plank 830 comprises preferred slots 852 and 853 formed thereon, and a preferred wall portion 861A of wall 860 proximal to plank 840 comprises preferred slots 862 and 863 formed thereon, wherein slots 852, 853, 862 and 863 are dimensioned to snuggly receive preferred tabs 230 and 232 of each preferred heating element 100. Furthermore, a preferred wall portion 851B of wall 850 proximal to plank 840 comprises preferred ridges 854 and 855 (not shown) formed thereon, and a preferred wall portion 861B of wall 860 proximal to plank 830 comprises preferred ridges 864 and 865 formed thereon, wherein the slots formed by ridges 854, 855, 864 and 865 are dimensioned to snuggly receive preferred ends 100A of each heating element 100. The distal ends of each plank 830 and 840 have a preferred slot 202 formed therein, wherein slot 202 is contiguous with preferred slots 202A formed on the distal ends of walls 850 and 860. Slots 202 and 202A are dimensioned to snuggly receive preferred protective screens 102, wherein protective screens 102 function to prohibit direct access to heating elements 100, yet still permit the egression of primary heated air 35 therethrough.

Preferably two juxtaposed preferred heating elements 222A and 222B are positioned on plank 830 and further rest on preferred supports 832 formed on plank 830. Likewise, preferably two juxtaposed preferred heating elements 222C and 222D are positioned on plank 840 and further rest on preferred supports 842 formed on planks 840. When heating elements 222A and 222B are positioned on plank 830, tabs 230 and 232 of heating element 222A are situated within slot 852 and tabs 230 and 232 of heating element 222B are situated within slot 853. Similarly, when heating elements 222C and 222D are positioned on planks 840, tabs 230 and 232 of heating element 222C are situated within slot 862 and tabs 230 and 232 of heating element 222D are situated within slot 863. Heating elements 222A–222D are preferably generally elongated rectangular in shape and are dimensioned to be received within the confinements created by planks 830 and 840 and walls 850 and 860 of lower heat shield 820. Preferred impeller 84 and accompanying preferred motor 88 are illustrated, wherein impeller 84 and accompanying motor 88 are preferably positioned within body 822 of lower heat shield 820. Impeller 84 and accompanying motor 88 are preferably generally circular shaped and dimensioned to fit within the confinements inherent in the size of lower heat shield 820. It should be noted that there are various other configurations and combinations of fan and motor assemblies such as, for exemplary purposes only, brushless motors, motors with stators and rotors, squirrel cage, blower, impeller fans and any other known means or devices that may be utilized. It should be construed that preferred impeller 84 as described herein to create a primary airflow could be any or all of the possible configurations described above or their equivalence and remain within the scope of the present invention. It is to be understood that preferably motor 88 and impeller 84 are commercially available from appropriate sources. Heating elements 222A–222D, impeller 84 and accompanying motor 88 and protective screens 102 carried by lower heat shield 820 are covered by a preferred upper heat shield 800, wherein upper heat shield 800 caps lower heat shield 820. Upper heat shield 800 comprises a generally circular shaped preferred body 802 having preferably two opposing substantially rectangular preferred planks 804 and 806 attached thereto. Body 802 preferably has a preferred aperture 803 centrally formed therethrough to permit impeller 84 to draw air there from and into heating module 16. Extending around the periphery of body 802 and planks 804 and 806 are preferred lips 808 and 810. Upper heat shield 800 in general is of the same shape of lower heat shield 820, but is fractionally larger than lower heat shield 820 such that when upper heat shield 800 is brought into contact with lower heat shield 820, lip 808 sits over wall 850 of lower heat shield 820, lip 810 sits over wall 860 of lower heat shield 820, and preferably four throughholes 801A–801D formed on body 802 and around the periphery of aperture 803 are aligned with channels 821A–D, respectively, of lower heat shield 820. Moreover, when upper heat shield 800 is joined with lower heat shield 820 is such a manner, the distal ends of planks 804 and 806 have defined there under slots 202B (not shown), dimensioned to fit over protective screens 102.

Although thermally insulative material, such as high temperature plastic or ceramic, is the preferred material for heat shields 800 and 820, there are various other methods and materials contemplated for isolating heating elements 100 (i.e., 222A–222D) from components affected by adverse heat. Among them, but not limited to, are other thermally insulative materials, heat sink heat shield materials, reflective materials and distance from adjacent components and their equivalence. There are also various electric heating elements 100 that may serve the same purpose. Among them, but not limited to, are PTC, ceramic, coiled wire or any other known method or materials including their equivalence. Denying consumer access, as a safety precaution, to heating elements 100 can be performed in various ways. Among them, but not limited to, are screens such as screens 102, bars, molded plastic, wire mesh or any other known methods or devices including their equivalence. It should be construed that the preferred heat shields 800 and 820, heating elements 100 and screens 102 as used in this specification implies that any or all of the possible elements, listed above and their equivalence, are within the scope of the invention.

Preferably positioned around the joined upper and lower heat shields 800 and 820, respectively, is preferred inlet support ring 14 and circular ring 601, wherein circular ring 601 is a substantially circular flat ring defining preferably two opposing substantially rectangular outlets 20. When circular ring 601 is placed around combined upper and lower heat shields 800 and 82b, respectively, outlets 20 are aligned with protective screens 102. Outlets 20 each further carry a preferred insert 831 having a preferred screened end 831A attached to a preferred insert end 831B, wherein insert end 831B is dimensioned to fit within outlet 20 and abut heat shields 800 and 820 upon full insertion of insert 831, thereby ensuring the complete channeling and exhaustion of primary airflow past heating elements 100, through insert end 831B and outlets 20 and past screened end 831A for mixture with secondary preferred upward airflow created by ceiling fan 22.

Heat shields 800 and 820 with enclosed impeller 84, motor 88, heating elements 100 and protective screens 102, are then secured between inlet support ring 14 and lower support plates 620 via the aid of threaded posts 640. Threaded posts 640 extend first from lower support plate 620 through throughholes 631. Threaded posts 640 then extend through channels 821A–821D of lower heat shield 820, each channel 821A–821D receiving one threaded post 640. Threaded posts 640 next extend through throughholes 801A–801D of upper heat shield 800, each of throughholes 801A–801D receiving one threaded post, and are secured thereto via preferred nuts 642. Threaded posts 640 are finally extended through throughholes 615 on inlet support plate 600 and secured thereto via preferred nuts 643.

Remote control receiver 610, which controls the electrical components of device 10, is mounted to lower support plate 620 via screws 676 which pass through throughholes 676A into threaded engagement with holes 676B.

Preferably, donut-shaped decorative cover 630 attaches to lower support plate 620 through the positioning of threaded studs 630A into throughholes 630B into threaded engagement with decorative nuts 630C.

Figure 2A:
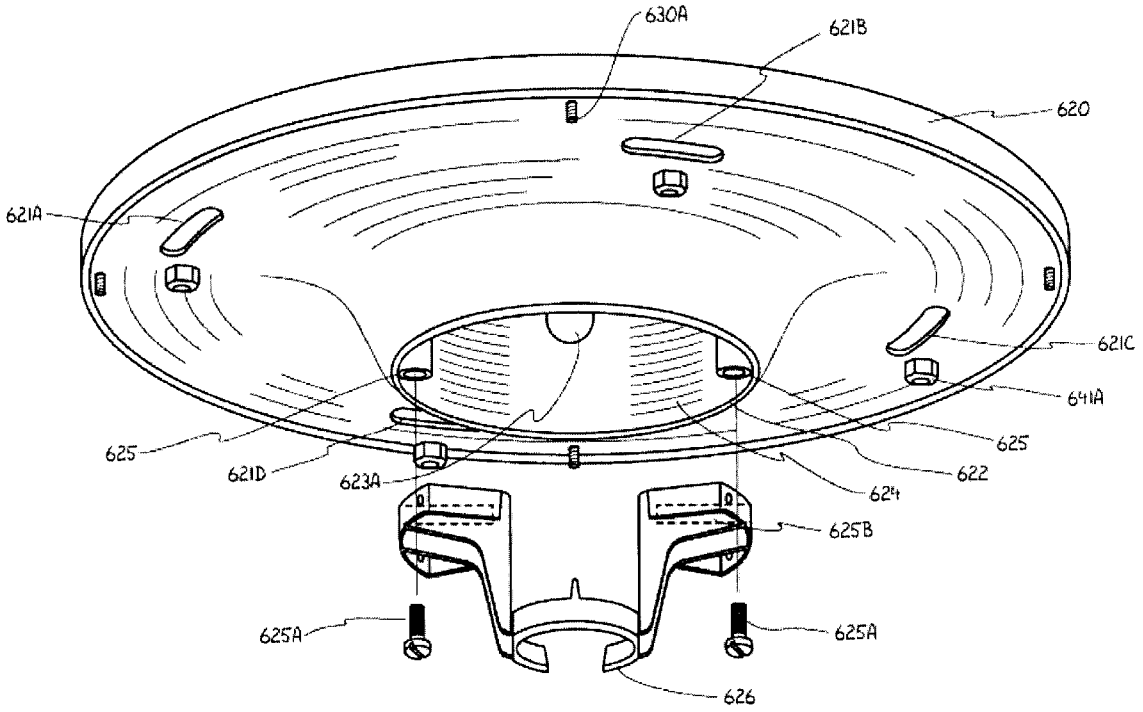
FIG. 2A is a bottom perspective view of a lower support plate of a ceiling mounted heating device according to a preferred embodiment of the present invention.

Referring now to FIG. 2A, is the bottom view of preferred lower support plate 620. Support plate 620 performs the further function as a mounting location for ceiling fan 22. Hollow enclosure 624 is recessed for the purpose of housing electrical conductors 50 and lip area 622 forms a mating surface for preferred conventional ceiling fan bracket 626. Preferred ceiling fan bracket 626 is preferably attached to lower support plate 620 via preferred screws 625A passing first through slots 625B and ending in threaded engagement with preferred holes 625.

Figure 3:
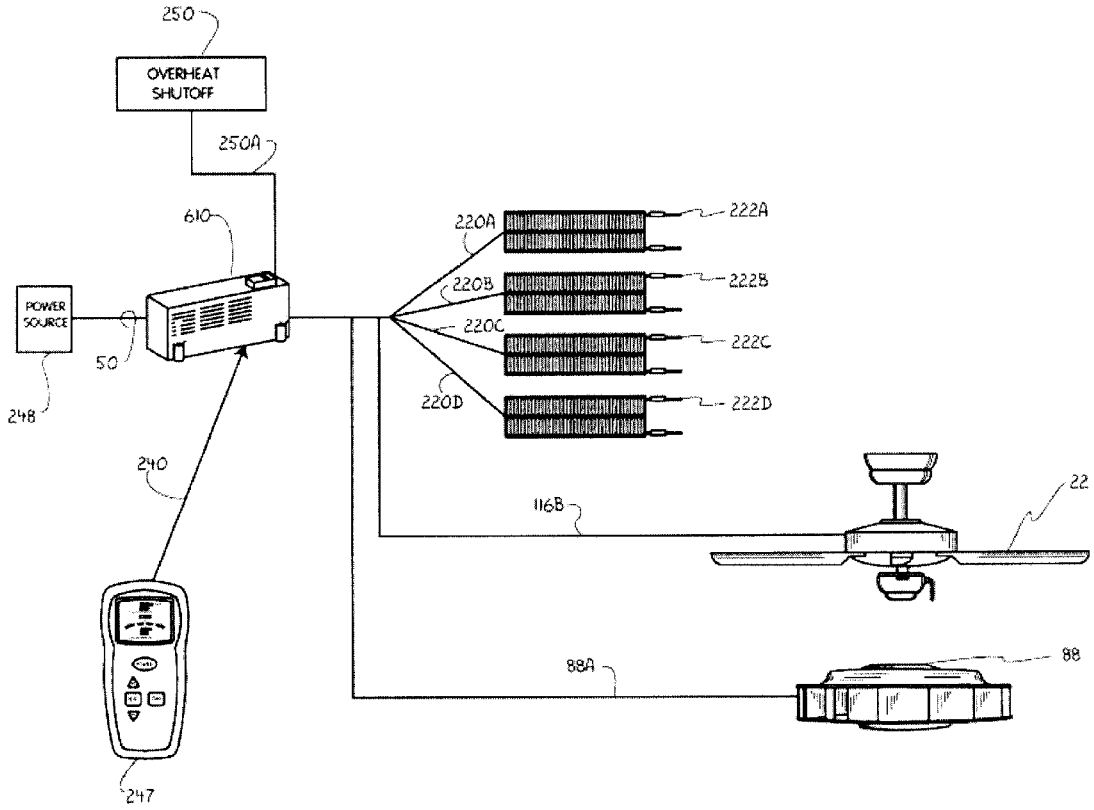
FIG. 3 is a schematic diagram of the control circuitry for a ceiling mounted heating device according to a preferred embodiment of the present invention.

Referring now to FIG. 3, a schematic diagram of a preferred apparatus for controlling operation of device 10 is illustrated. It should be noted that both remote control receiver unit 610 and preferred transmitter 247 are commercially derived units that rely on digital readouts and computerization for size. New instructions for regulating heating elements 100 should be programmed into remote control receiver unit 610 and transmitter 247 for operation of device 10. Contained within the functions of transmitter 247 and remote control receiver unit 610 are device 10 activation and deactivation switches, switches for activating a desired number of heating elements 100, switches for powering ceiling fan 22, as well as a digital display to indicate the chosen function, switches to increase or decrease desired temperature when in the heating mode, digital monitoring of both desired and actual temperature when in the heating mode, and digital monitoring of the number of heating elements 100 activated when in the heating mode.

There are various ways to regulate the amount of heat generated by a heating device. Among them, but not limited to, are analog switches, pull chains, buttons, timers, thermostats, remote control devices, their equivalence or any known means. It should be construed that the preferred manual or automatic remote control devices with their associated remote control receiver unit 610 could be, in alternate embodiments, any or all of the possible ways to regulate, as listed above, and are within the scope of the invention. A remote control receiver unit 610 preferably receives control signals 240 from transmitter 247. It is to be understood that the functions to be described of transmitter 247 may be incorporated into either a single unit or multitude of units. A source of power 248, such as conventional 120/220-volt alternating current available in all dwellings and office buildings, provides power via conductors 50 to remote control receiver unit 610; or, in an alternate embodiment, remote control receiver unit 610 may be battery or solar operated. Transmitter 247 may be battery powered or hard wired to a source of conventional 120/220-volt alternating current. Remote control receiver unit 610, on command, energizes one or more of heating elements 222 (A, B, C and/or D) via preferred conductors 220 (A, B, C and/or D, respectively) under command of transmitter 247. Along with energization of one or more of heating elements 222A–222D, motor 88 and impeller 84 are energized via preferred conductor 88A to cause a primary airflow 32 to move past heating elements 222A–222D and exhaust from heating module 16 as primary heated airflow 35. To distribute primary heated airflow 35 throughout a room, a ceiling fan 22 is energized via preferred conductor 116B to provide a secondary airflow 34 for mixing with primary heated airflow 35, resulting in the subsequent distribution of a mixture of airflows throughout the room in which heating is desired. For safety reasons, a preferred overheat shut-off module 250 may be connected via preferred conductor 250A through remote control receiver unit 610 and cause de-energization of heating elements 222A–222D upon the occurrence of an overheat condition.

Referring now to FIGS. 4A through 7B, there is illustrated the operation of preferred transmitter 247 and the resulting effect on heating module 16 and its main components, impeller 84 and heating elements 222A, 222B, 222C and 222D, to create a primary heated airflow. As depicted, preferred transmitter 247 includes options for power-on or power-off of device 10; monitoring and selecting heat and fan settings; monitoring and setting desired temperature; monitoring actual room temperature; and monitoring the number of heating elements 100 currently in use. Also depicted is the preferred tandem configuration of heating elements 100. In this preferred configuration, the temperature of the exhausted airflow is enhanced by first passing through one heating element 100 and subsequently through another heating element 100 to raise the temperature of the exiting airflow. If the device is to be used, the power button on preferred transmitter 247 is depressed and the digital display is actuated. For heating the "HEAT" button is then depressed highlighting the word "HEAT" on the digital display and activating the heating module. The desired temperature is then set with the "+" and "–" buttons above and below the heat button, wherein depression of the "+" and "–" buttons changes the desired temperature digital display. Heating module 16 then automatically activates impeller 84, one or more of heating elements 222A, 222B, 222C and 222D depending on the temperature range between desired and actual temperature. Ceiling fan 22 is also powered and should preferably be set, through its endemic control capability, to rotate in the preferably upward direction. If only the fan is required for cooling, the "FAN" button is depressed, causing the word "FAN" to become highlighted on the digital display and only the power to ceiling fan 22 is activated and is controlled via the endemic control capability of ceiling fan 22. Upon initial startup, in the heat mode, and assuming that the desired temperature is at least three degrees higher than the actual temperature, preferred transmitter 247 will activate all heating elements 222A–222D in order to quickly narrow the gap between actual room temperature and desired room temperature. As the gap narrows heating elements 222A–222D will be automatically deactivated until only the minimum required to maintain the desired temperature are producing heat. It is to be noted that any computer algorithm may be applied to preferred transmitter 247 and preferred remote control receiver unit 610 combinations to activate the timing of heating element 100 activation or deactivation. Any or all of those algorithms must be considered within the scope of the present invention.

Figure 4A:
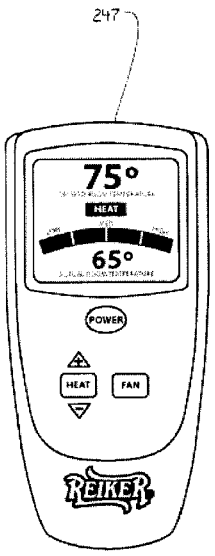
FIGS. 4A and 4B illustrate preferred control units and the corresponding actuated heating elements of a ceiling mounted heating device according to a preferred embodiment of the present invention.
Figure 4B:
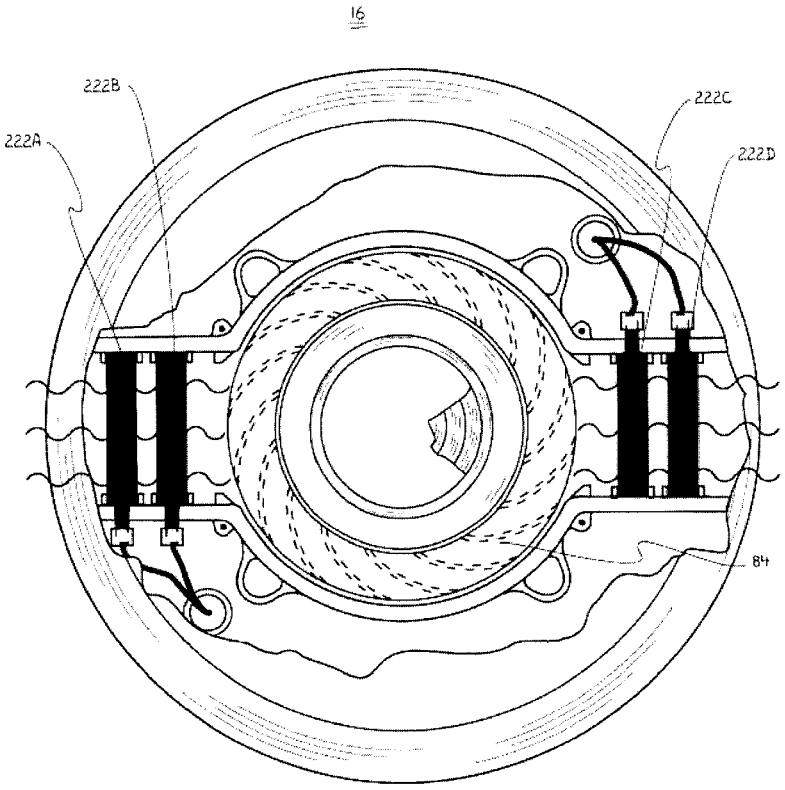
Figure 5A:
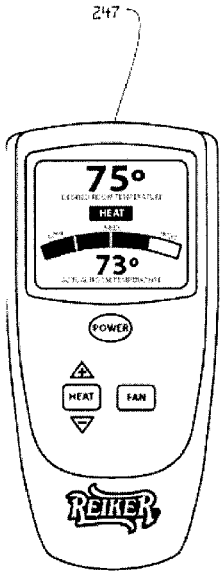
FIGS. 5A and 5B illustrate preferred control units and the corresponding actuated heating elements of a ceiling mounted heating device according to a preferred embodiment of the present invention.
Figure 5B:
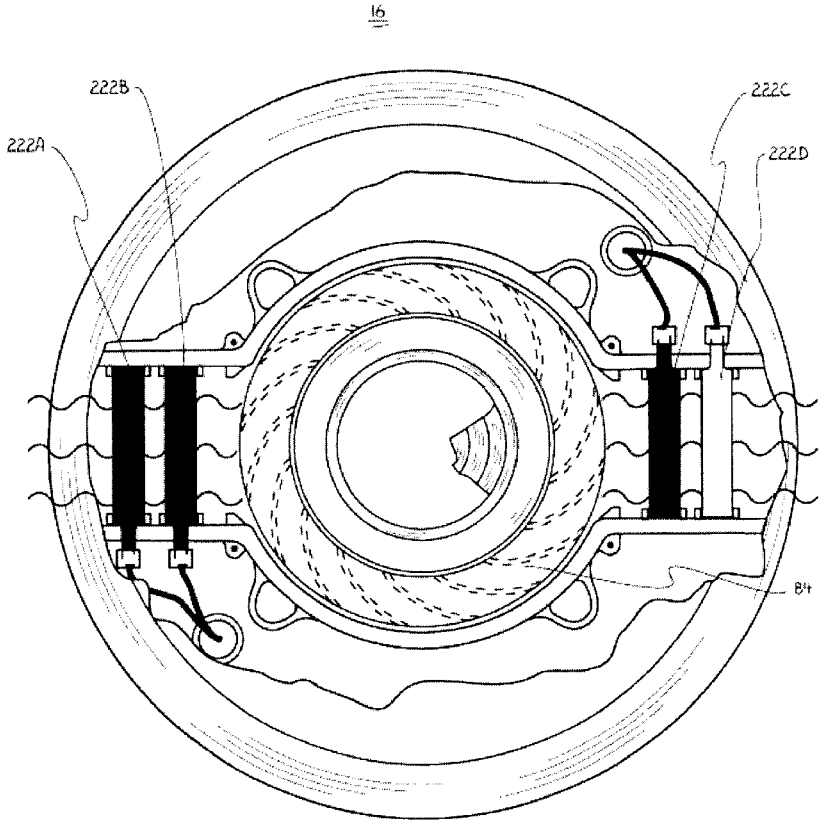
Figure 6A:
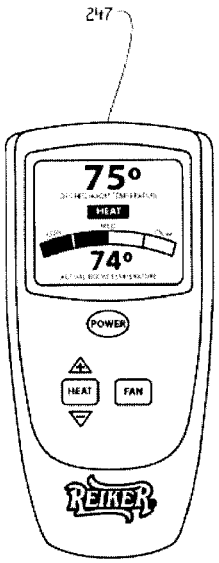
FIGS. 6A and 6B illustrate preferred control units and the corresponding actuated heating elements of a ceiling mounted heating device according to a preferred embodiment of the present invention.
Figure 6B:
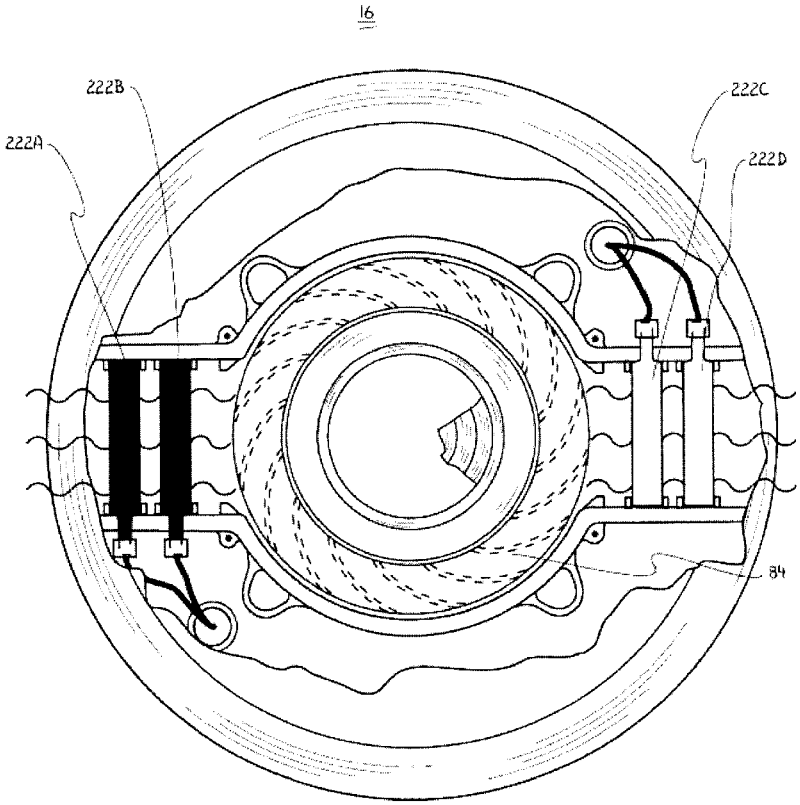
Figure 7A:
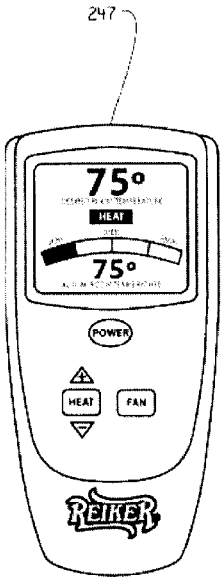
FIGS. 7A and 7B illustrate preferred control units and the corresponding actuated heating elements of a ceiling mounted heating device according to a preferred embodiment of the present invention.
Figure 7B:
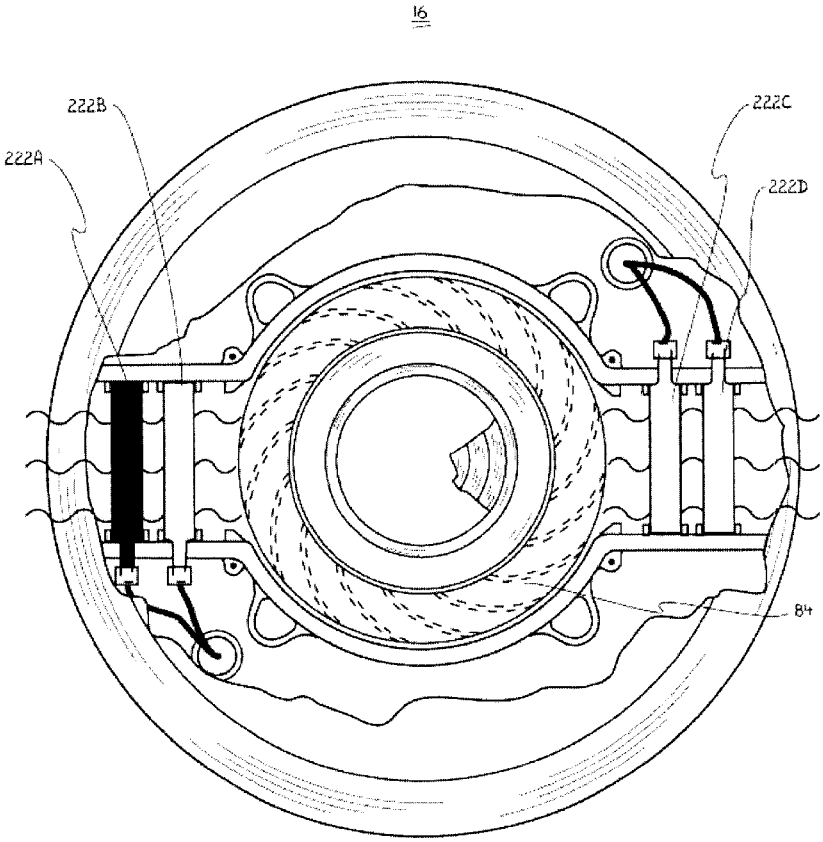

As illustrated in FIGS. 4A and 4B, desired temperature 75 degrees and actual room temperature are separated by 10 degrees causing all heating elements 222A–222D to be activated for increasing the room temperature. As illustrated in FIGS. 5A and 5B, when the desired temperature and actual temperature as indicated on preferred transmitter 247 near, heating elements 222A–222D will start to deactivate in order to maintain the desired room temperature. FIGS. 5A and 5B illustrate the condition where only three heating elements 222A, 222B and 222C are activated. FIGS. 6A and 6B illustrate a condition where only two heating elements 222A and 222B are activated, and FIGS. 7A and 7B illustrate the ultimate condition where only heating element 222A is activated to maintain the desired temperature. Should the actual temperature drop due to a decrease in outside air temperature, an open door or open window, transmitter 247 will command the reactivation of heating elements 222B, 222C or 222D to maintain the desired room temperature. It is this preferred function that enables air recirculating and heating device 10 to efficiently use electrical energy to heat a room.

Figure 8:
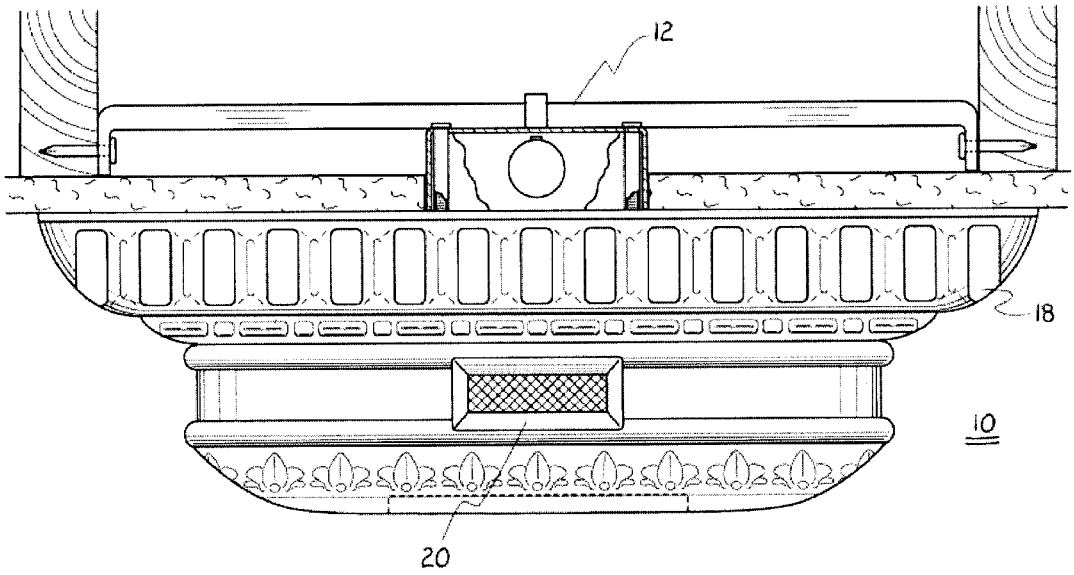
FIG. 8 is a side view of a ceiling mounted heating device according to a preferred embodiment of the present invention.

Referring now to FIG. 8, there is illustrated device 10 with optional decorative elements or housings. It is to be understood that the exterior configuration illustrated is simply one of a multitude of decorative exterior configurations that may be used. Device 10 is adapted from an upward location within a room, such as the ceiling of the room. A preferred ceiling fan brace 12 may be incorporated for adapting the device. Device 10 preferably includes inlets 18 for moving air to be heated into device 10 and also preferably includes outlets 20 disposed about device 10 for expelling the primary airflow of heated air as a function of the amount of heating to be performed.

Figure 9:
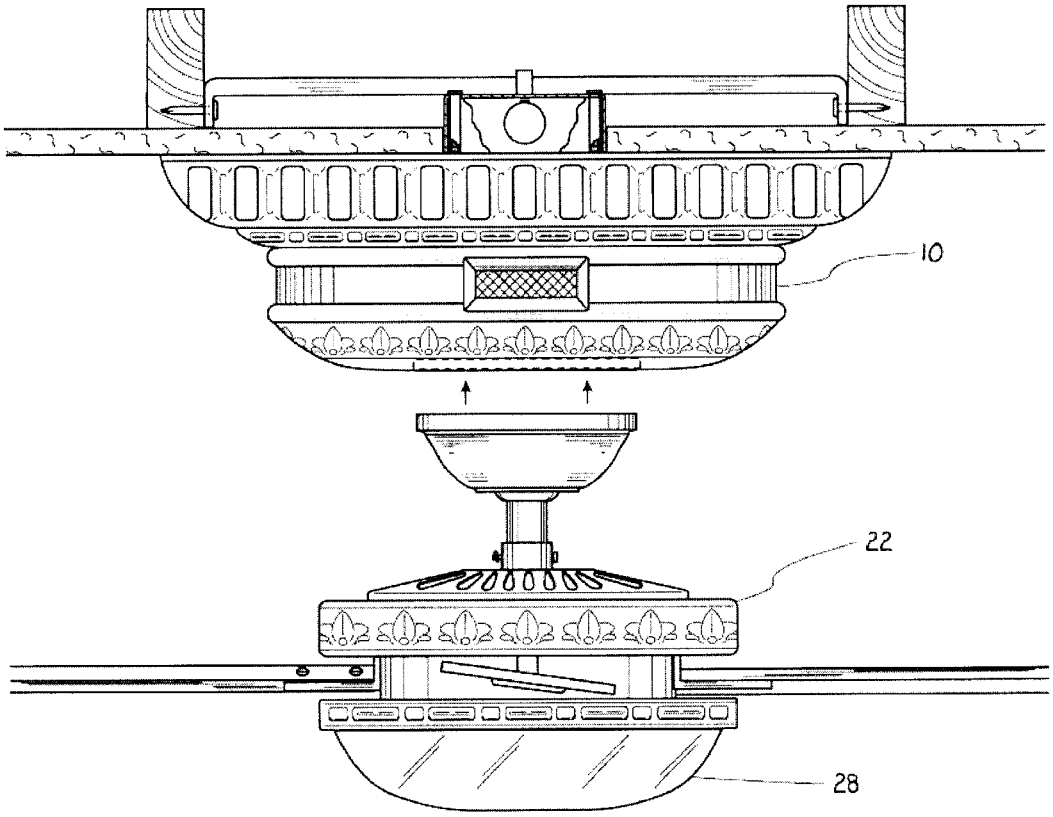
FIG. 9 is a side view of a ceiling mounted heating device according to a preferred embodiment of the present invention showing how a ceiling fan may adapt thereto.

FIG. 9 illustrates how the load-bearing device 10 adapts a ceiling fan 22 and optional light module 28. Ceiling fan 22 produces a secondary airflow that is directed upward during a heating phase and downward during a cooling phase.

Figure 10:
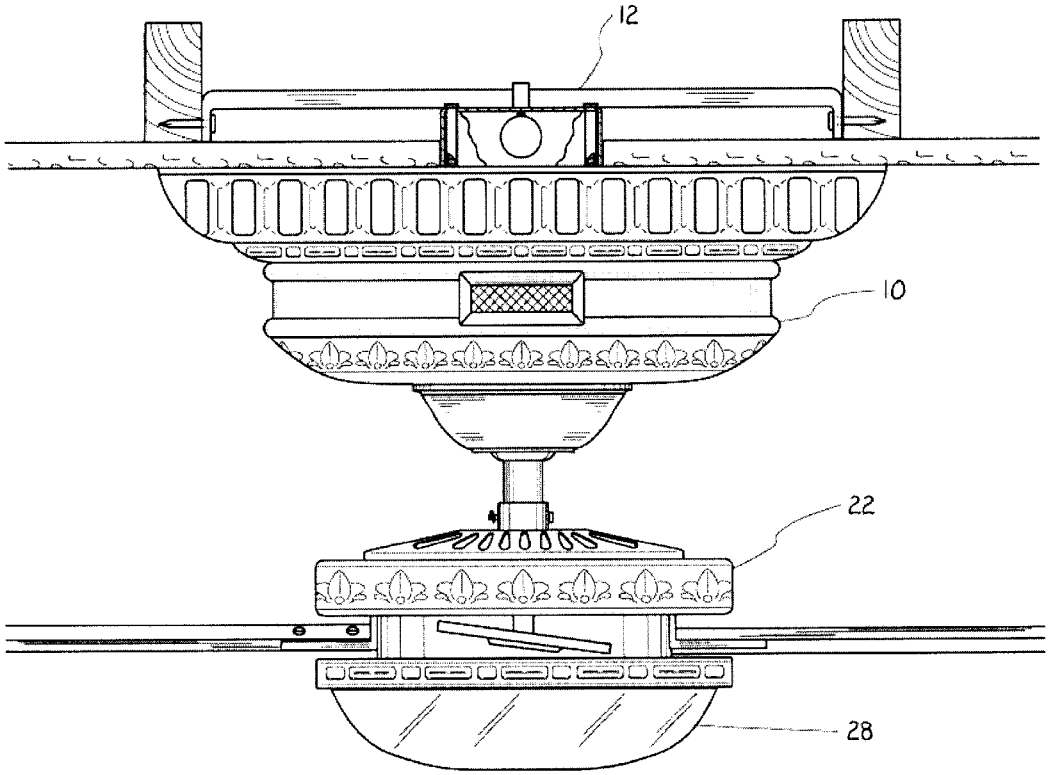
FIG. 10 is a side view of a ceiling mounted heating device according to a preferred embodiment of the present invention showing a ceiling fan adapted thereto.

FIG. 10 is a side view of the present invention depicting preferred ceiling fan brace 12, device 10, ceiling fan 22 and the optional light module 28 in assembled configuration.

Figure 10A:
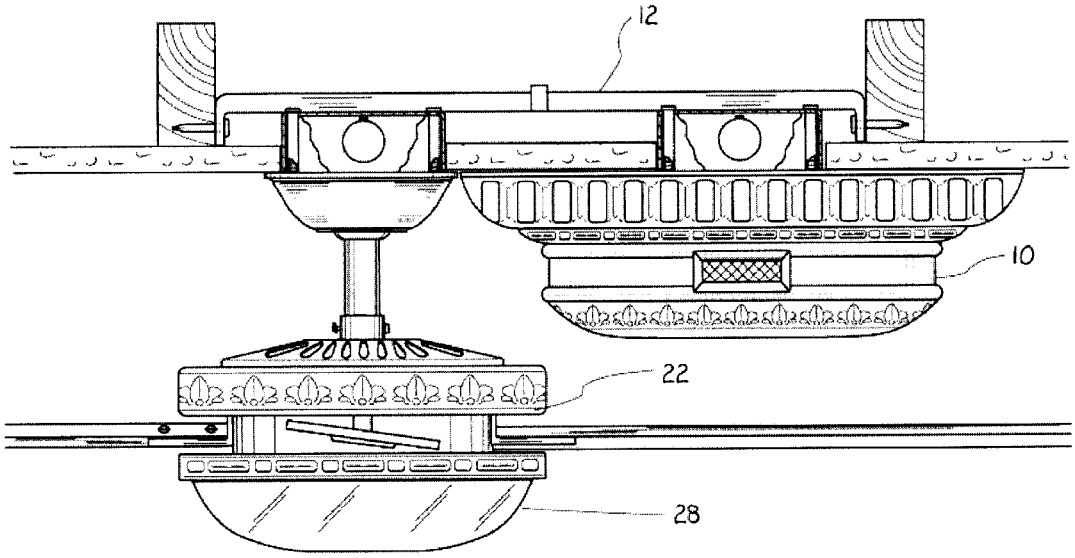
FIG. 10A is a side view of a ceiling mounted heating device according to a preferred embodiment of the present invention mounted independently of a ceiling fan.

FIG. 10A is a side view of device 10 and ceiling fan 22 in two separate locations. Although not aesthetically pleasing, the cyclonic airflow created by ceiling fan 22, in either an upward or downward airflow, serves to distribute the heated airflow throughout the heated airspace.

Figure 11:
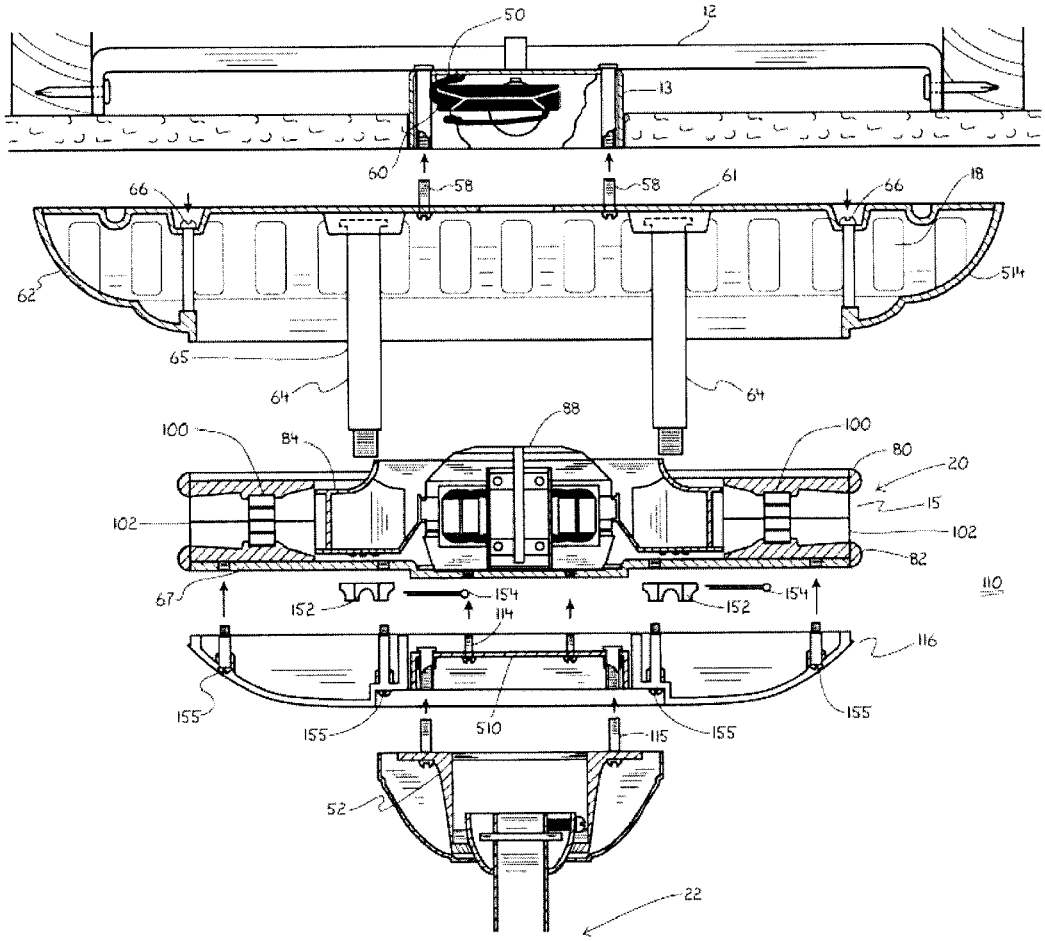
FIG. 11 is a cross-sectional side view of a ceiling mounted heating device according to an alternate embodiment of the present invention showing the device in an unassembled configuration.

Referring now to FIG. 11, shown in an alternate embodiment is a cross-sectional view of device 110 depicting various component parts in an unassembled configuration. Device 110 preferably generally comprises an inlet support module 514, a heating module 15 and a ceiling fan support module 116. Preferred ceiling fan brace 12 and an integrated electrical box 13 are adapted to an upward location—preferably the ceiling of a room. (Various configurations and methods of mounting are available to the consumer; the preferred ceiling fan brace 12 is but one method of mounting device 110 and it is in general irrelevant to the function of the invention.) There are various methods and designs for adaptation and joining of inlet support module 514, heating module 15 and ceiling fan support module 116. Among them, but not limited to, are screws, pins, nuts, bolts, rivets, adhesive, spring retention and custom fittings. The preferred means of adaptation and joining sited throughout this specification meet the requirement of the design and manufacturability, but all methods are within the scope of the invention.

Inlet support module 514 preferably generally comprises upper support plate 61 and inlet housing 62, wherein upper support plate 61 is preferably substantially circular or disk-shaped and inlet housing 62 is preferably bowl-shaped. Upper support plate 61 of inlet support module 514 is adapted to electrical box 13 by use of an attachment means depicted as screws 58. Inlet housing 62 further preferably contains inlets 18 and is adapted to preferred upper support plate 61 by an attachment means depicted by preferred screws 66.

Housed preferably within electrical box 13 is preferred receiver control unit 60. (Location of preferred receiver control unit 60 may be anywhere within device 10 as location does not alter the function of the invention. It is also not a requirement of the invention to be activated and controlled by a remote control device, but is rather one of convenience for the consumer. Component devices like, but not limited to, analog switches, pull chains or hardwired devices will perform, to a lesser convenience, the same function; all, however, should be considered within the scope of this invention.) Electrical conductors 50 are electrically connected to a source of electric power to provide power for the various electrical components. Preferred receiver control unit 60 preferably controls the operation of heating module 15, ceiling fan 22 and optional light kit 28.

Heating module 15 preferably includes a lower support plate 67, heating elements 100, protective screens 102 and preferred impeller 84 powered by preferred motor 88 and adapted to inlet support module 514 by preferred pins 64 and preferred castle nuts 152. Preferred cotter pin 154 prevents loosening of preferred castle nuts 152. A heat sink barrier of heat sink or heat insulative material and hereinafter referred to as upper heat shield 80 and lower heat shield 82 nestingly support heating elements 100 to minimize heat transfer between heating elements 100 and surrounding components. This feature ensures the uncompromised performance of both preferred motor 88 and ceiling fan 22. Preferred spacers 65, adapted to preferred pins 64, ensure the proper spacing between preferred upper support plate 61 and preferred lower support plate 67 and allow preferred castle nuts 152 to achieve adequate torque to secure heating module 15 to inlet support module 14.

Furthermore, although thermally insulative material, such as high temperature plastic or ceramic, is the preferred material for heat shields 80 and 82, there are various other methods and materials contemplated for isolating heating elements 100 from components affected by adverse heat. Among them, but not limited to, are other thermally insulative materials, heat sink heat shield materials, reflective materials and distance from adjacent components and their equivalence. There are also various electric heating elements 100 that may serve the same purpose. Among them, but not limited to, are PTC, ceramic, coiled wire or any other known method or materials including their equivalence. Denying consumer access, as a safety precaution, to heating elements 100 can be performed in various ways. Among them, but not limited to, are screens such as screens 102, bars, molded plastic, wire mesh or any other known methods or devices including their equivalence. It should be construed that the preferred heat shields 80 and 82, heating elements 100 and screens 102 as used in this specification implies that any or all of the possible elements, listed above and their equivalence, are within the scope of the invention.

Ceiling fan support module 16 is preferably bowl-shaped and adapted to heating module 15 by preferred screws 155. Preferred ceiling fan support bracket 510 of ceiling fan support module 116 is adapted to heating module 15 by preferred screws 114, wherein preferred screws 114 further function to secure preferred motor 88 to preferred lower support plate 67. Ceiling fan bracket 52 and associated conventional hardware are adapted to support bracket 510 with preferred screws 115.

Figure 12:
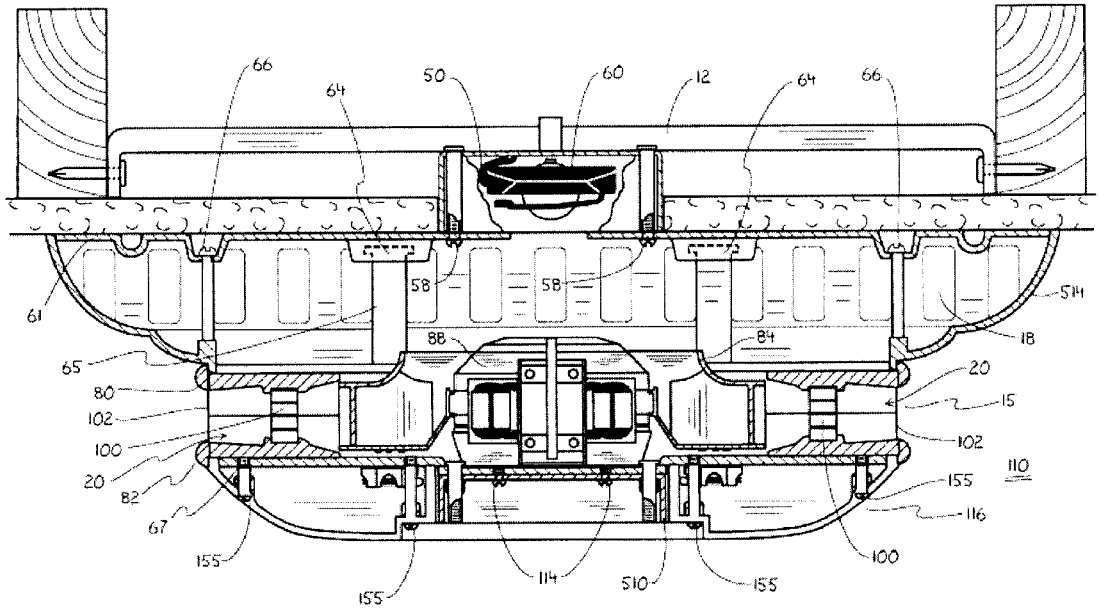
FIG. 12 is a cross-sectional side view of a ceiling mounted heating device according to an alternate embodiment of the present invention showing the device in an assembled configuration.

Referring now to FIG. 12, inlet support module 514, heating module 15 and ceiling fan support module 116 are adapted to form device 110. The flanged top of preferred pins 64 rests on preferred upper support plate 61 while spacers 65 define the dimension between preferred lower support plate 67, upper heat shield 80 and lower heat shield 82. Preferred pins 64 further ensure the secure joining of upper heat shield 80 and lower heat shield 82, wherein the resulting union of upper heat shield 80 and lower heat shield 82 further provides for the secure location and positioning of heating elements 100. Preferred castle nut 152, when properly torqued to preferred pin 64 ensures the secure joining of inlet support module 514, heating module 15 and ceiling fan support module 116. Preferred cotter pin 154 prevents the inadvertent loosening of preferred castle nut 152.

Figure 13:
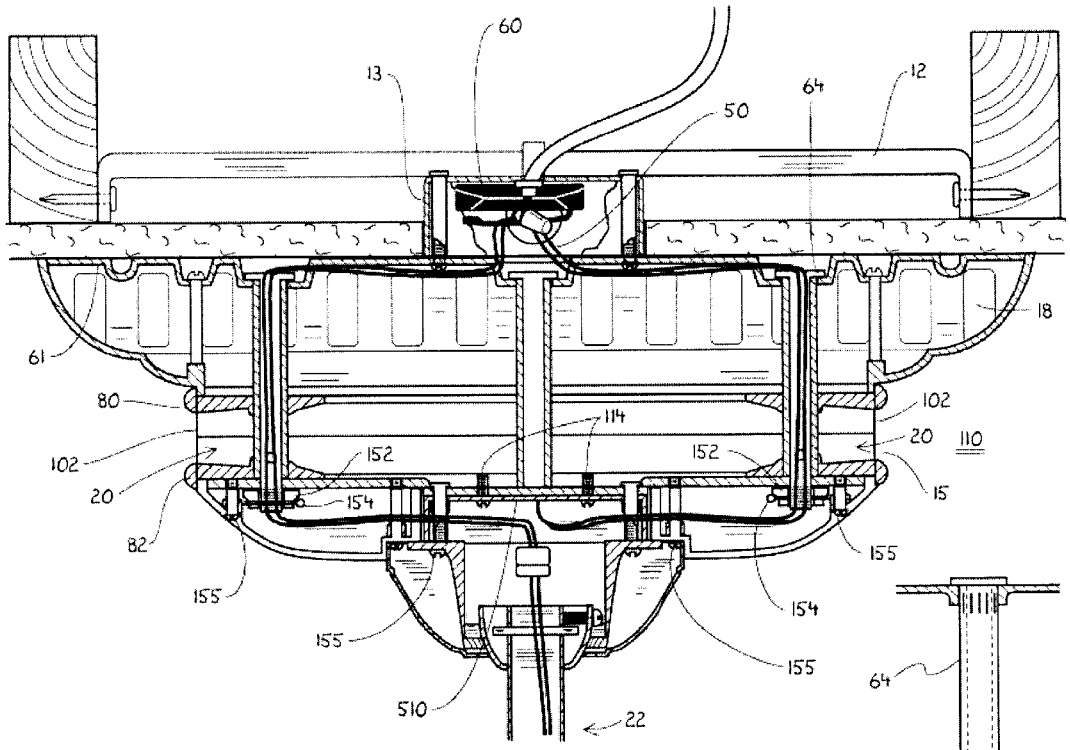
FIG. 13 is a cross-sectional side view of a ceiling mounted heating device according to an alternate embodiment of the present invention shown without an impeller.
Figure 13A:
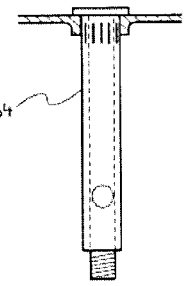
FIG. 13A is a side view of a preferred pin of a ceiling mounted heating device according to an alternate embodiment of the present invention.

Referring now to FIGS. 13 and 13A, device 110 is shown without both preferred impeller 84 and preferred motor 88, but with both the load-bearing capability to support ceiling fan 22 and plurality of electrical conductors 50 routed for electrical connection with their respective electrical components. In this embodiment of device 110, preferred pins 64 are preferably of a hollow configuration to assist in the definition of the path for routing electrical conductors 50. Various means of routing electrical conductors 50 can be anticipated by those skilled in the art and are within the scope of the invention. From previous discussions pertinent to FIGS. 11 and 12, several features may be emphasized. First, the use of a common shaft to support a ceiling fan has been omitted and replaced by the load bearing capacity of device 110. Second, device 110 includes a mounting location. Preferred ceiling fan support bracket 510 is of sufficient strength and robustness to support ceiling fan 22. Third, the configuration, number and size of each of the components of device 110 may be altered to conform to the specific space and power requirements without departing from the design philosophy attendant device 110 as described herein.

Figure 14:
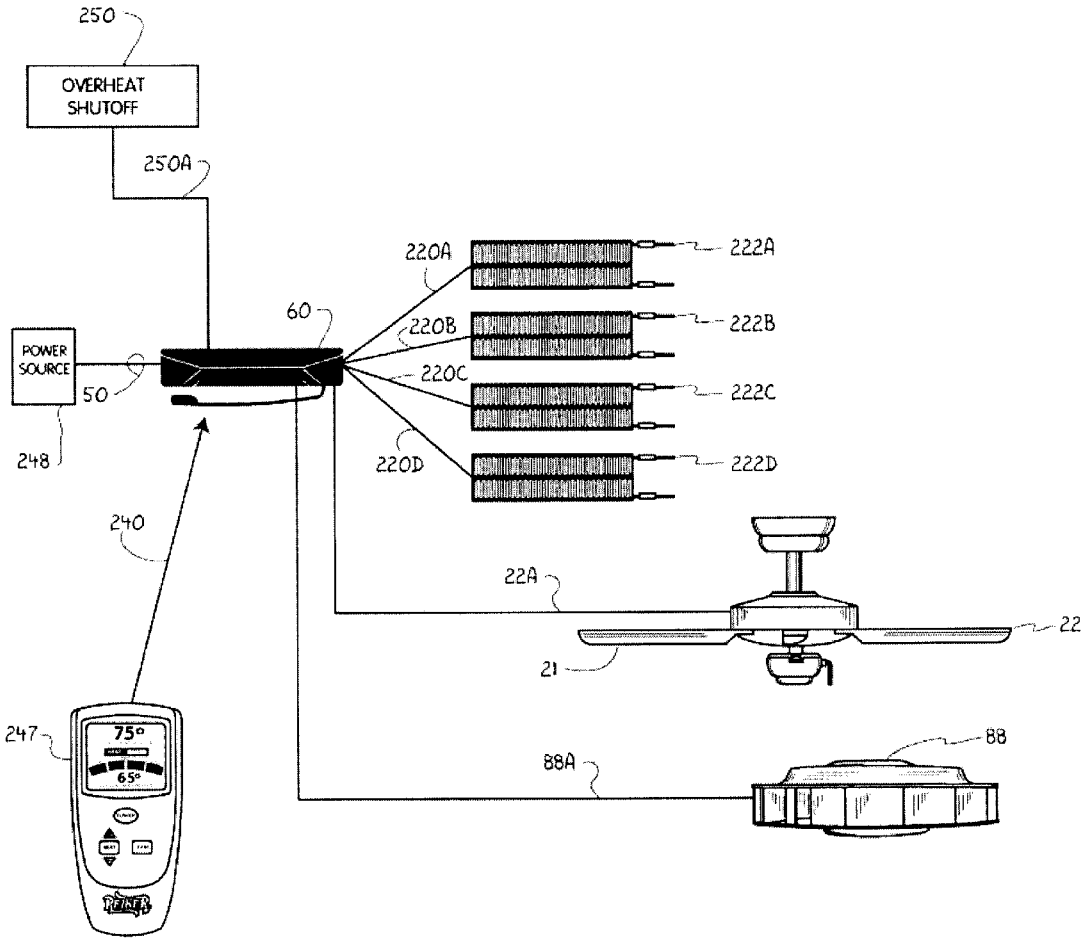
FIG. 14 is a schematic diagram of the control circuitry for a ceiling mounted heating device according to an alternate embodiment of the present invention.

Referring now to FIG. 14, there is illustrated a schematic diagram of a system for controlling the operation of device 110 alone or in combination with ceiling fan 22. There are various ways to regulate the amount of heat generated by a heating device and its accompanying electrical components. Among them, but not limited to, are analog switches, pull chains, buttons, timers or remote control devices. The preferred manual or automatic remote control device 247 with its associated preferred remote control receiver 60 was chosen to best serve the needs of the consumer. It should be noted by one skilled within the art that any or all of the possible ways to regulate device 110, as listed above, are within the scope of the invention. A preferred remote control receiver 60, mounted preferably within electrical box 13 adjacent a ceiling or other support structure, receives control signal 240 from a first preferred transmitter 247. A source of power 248, such as conventional 120-volt or 220-volt alternating current available in all dwellings and office buildings, provides power via conductors 50 to preferred remote control receiver 60. Preferred remote control receiver 60 may alternatively be battery operated. Preferred transmitter 247 can be battery powered or hard wired to a source of conventional 120-volt or 220-volt alternating current. The preferred remote control receiver 60 preferably energizes heating elements 222 (A, B, C and/or D) via conductors 220 (A, B, C and/or D) under command of preferred transmitter 247. Along with energization of heating elements 222, preferred motor assembly 88, actuating preferred impeller 84, is energized via conductor 88A to cause a primary airflow to move through heating elements 222 and exhaust laterally from heating module 15. To distribute the heated primary airflow throughout a room, ceiling fan 22 is energized via conductor 22A to cause attached fan blades 21 to provide a secondary airflow for mixing with the heated primary airflow, resulting in the subsequent distribution of the mixture of airflows throughout the room. For safety reasons, a preferred overheat shut off module 250 may be connected via conductor 250A through preferred remote control receiver 60 to allow for de-energization of heating elements 222 upon the occurrence of an overheat condition.

Figure 15:
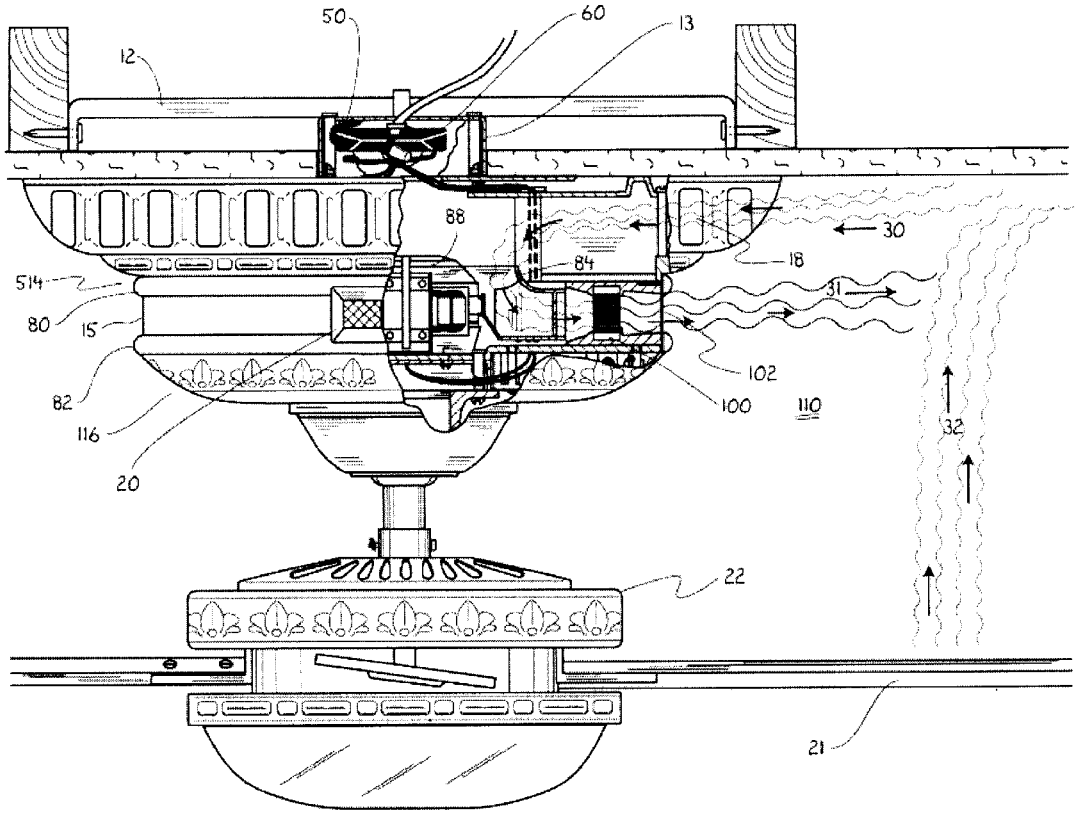
FIG. 15 illustrates airflow into and out of a ceiling mounted heating device according to an alternate embodiment of the present invention showing mixture of the primary airflow with the secondary upward airflow created by a ceiling fan.

Referring now to FIG. 15, there is illustrated the operation of device 110. Upon energization of heating module 15, preferred impeller 84 activated by preferred motor 88 moves molecules of air represented by lines 30, through inlets 18 into heating module 15. Moved air 30 is urged through heating elements 100 for heating, and is thereafter urged through protective screen 102 to be expelled as a primary heated airflow 31 through outlets 20. As a result, primary heated airflow 31 mixes with a preferably upward secondary airflow 32, wherein upward secondary airflow 32 is provided by adapted ceiling fan 22 for distribution of mixed primary heated airflow 31 and upward secondary airflow 32 throughout the room.

Figure 16A:
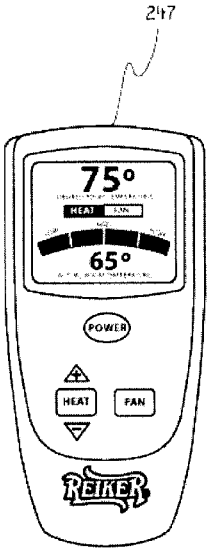
FIGS. 16A and 16B illustrate preferred control units and the corresponding actuated heating elements of a ceiling mounted heating device according to an alternate embodiment of the present invention.
Figure 16B:
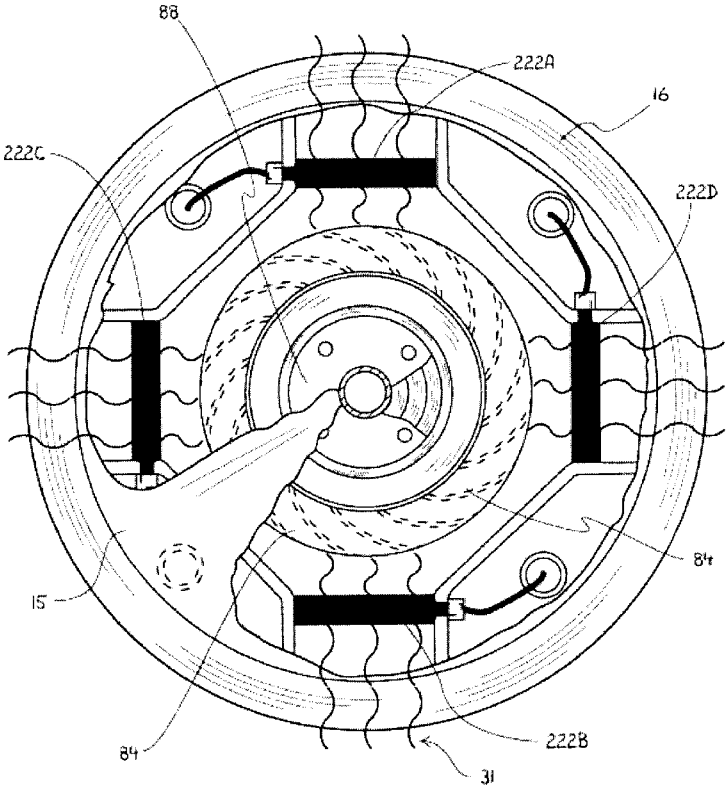

FIGS. 16A and 16B illustrate operation of preferred transmitter 247 and the resulting effect of transmitter 247 on impeller 84 and heating elements 222A, 222B, 222C and 222D of heating module 15 to create primary heated airflow 31. Preferred transmitter 247 includes options for power-on and/or power-off, monitoring actual room temperature, adjusting fan speed, adjusting illumination of the light module and monitoring the number of heating elements in use. If the room is to be heated, a power button on preferred remote control transmitter 247 is depressed and a digital display is preferably actuated. A button or switch preferably marked "HEAT" is then depressed, preferably highlighting the word "HEAT" on the digital display and activating heating module 15. The desired temperature can then be regulated via "+" and "−" buttons positioned preferably above and below, respectively, the button marked "HEAT", wherein depression of the "+" or "−" button changes the temperature as indicated on the digital display. Heating module 15 thereafter preferably automatically activates impeller 84, one or more of heating elements 222A, 222B, 222C and/or 222D depending on the temperature range between the desired and actual temperature, and finally rotation of fan 22 to push air in the upward direction. Alternatively, if only fan 22 is desired for cooling, a button marked "FAN" is preferably depressed, resulting preferably in the word "FAN" being highlighted on the digital display of preferred remote control transmitter 247 and the rotation of fan 22 to push air in the downward direction. The speed of rotation of fan 22 is preferably adjusted via controls endemic to ceiling fan 22. Upon initial startup, when device 10 is in the heating mode and assuming that the desired temperature is preferably at least three degrees higher than the actual temperature, preferred transmitter 247 preferably activates all heating elements 222A, 222B, 222C and 222D in order to quickly narrow the gap between actual room temperature and desired room temperature. As the gap narrows, heating elements 222A, 222B, 222C and/or 222D will systematically and automatically deactivate until only the minimum number of heating elements 222 required to maintain the desired temperature are producing heat. As illustrated in FIGS. 16A and 16B, the desired temperature of 75 degrees and actual room temperature are separated by 10 degrees causing all heating elements 222A, 222B, 222C and 222D to be activated for the purpose of increasing the room temperature.

Figure 17A:
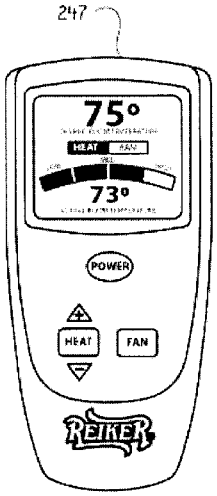
FIGS. 17A and 17B illustrate preferred control units and the corresponding actuated heating elements of a ceiling mounted heating device according to an alternate embodiment of the present invention.
Figure 17B:
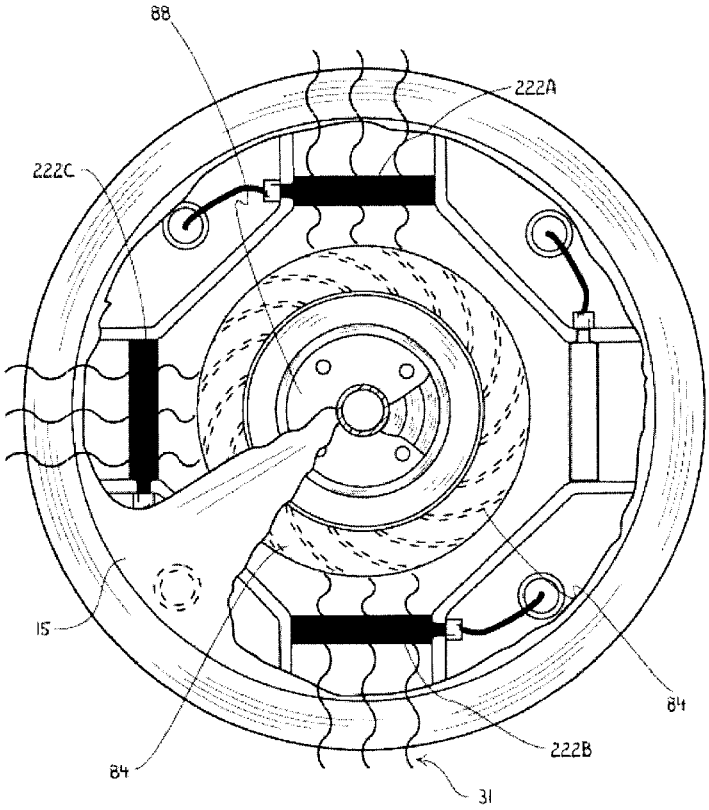
Figure 18A:
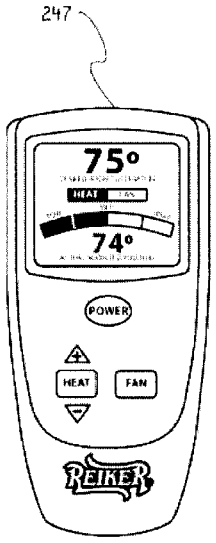
FIGS. 18A and 18B illustrate preferred control units and the corresponding actuated heating elements of a ceiling mounted heating device according to an alternate embodiment of the present invention.
Figure 18B:
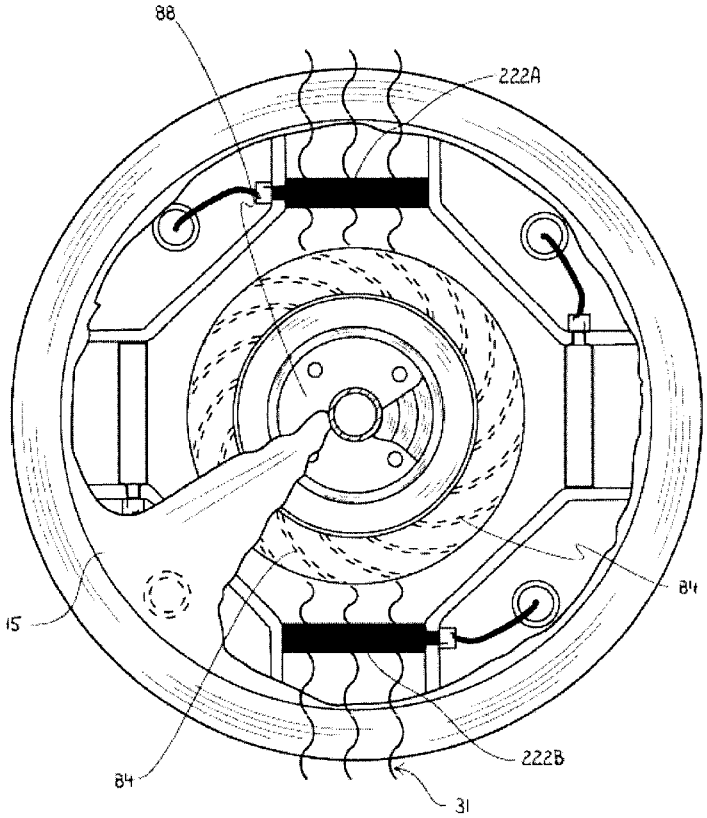
Figure 19A:
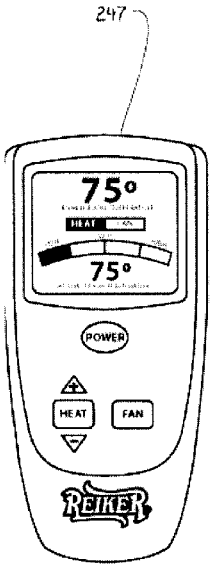
FIGS. 19A and 19B illustrate preferred control units and the corresponding actuated heating elements of a ceiling mounted heating device according to an alternate embodiment of the present invention.
Figure 19B:
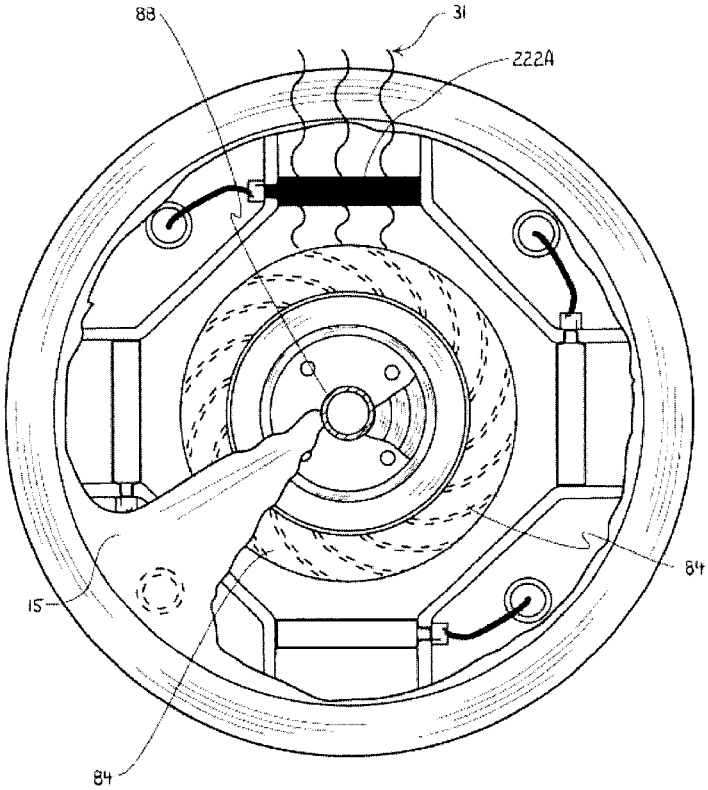

As depicted in FIGS. 17A and 17B, the actual temperature and the desired temperature as determined by preferred transmitter 247 have neared, thereby causing device 110 to enter a "maintaining phase" of operation by preferably systematically deactivating heating elements 222A, 222B, 222C and/or 222D. As depicted in FIGS. 17A and 17B, only three heating elements 222A, 222B and 222C are activated. FIGS. 18A and 18B illustrate a condition where only heating elements 222A and 222B are activated, and FIGS. 19A and 19B illustrate the ultimate condition wherein only heating element 222A is activated in order to maintain the desired temperature. Should the actual temperature drop due to a decrease in outside air temperature, an open door and/or an open window, remoter control receiver 247 will command the reactivation of heating elements 222B, 222C and/or 222D, thereby maintaining desired room temperature. In such a preferred mode of function, device 110 is able to efficiently utilize electrical energy to heat a room.

Figure 20:
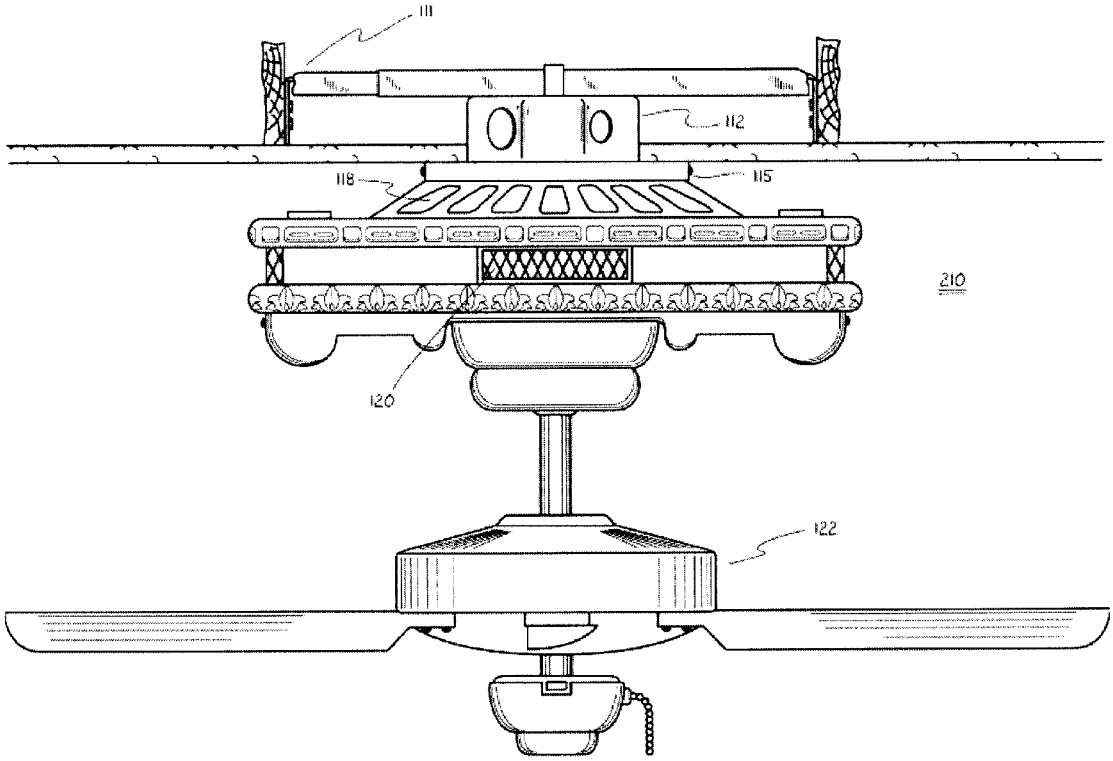
FIG. 20 is a side view of a ceiling mounted heating device according to an alternate embodiment of the present invention showing a ceiling fan adapted thereto.

Referring now to FIG. 20, there is illustrated device 210 according to an alternate embodiment of the invention and shown with optional decorative elements or housings. It is to be understood that the exterior configuration illustrated is simply one of a multitude of decorative exterior configurations that may be used. Device 210 is preferably adapted from an upward location within a room, such as the ceiling of the room. A preferred ceiling fan brace 111 and electrical box 112 may be incorporated for adapting device 210 to such an upward location. Device 210 includes inlets 118 for moving air into device 210 to be heated, and outlets 120 disposed thereabout for expelling and providing a primary heated airflow as a function of the amount of heating to be performed. Such an embodiment also provides a location to adapt a ceiling fan 122. It is recognized in an alternate embodiment that device 210 may incorporate any number of inlets 118 and outlets 120.

Figure 21:
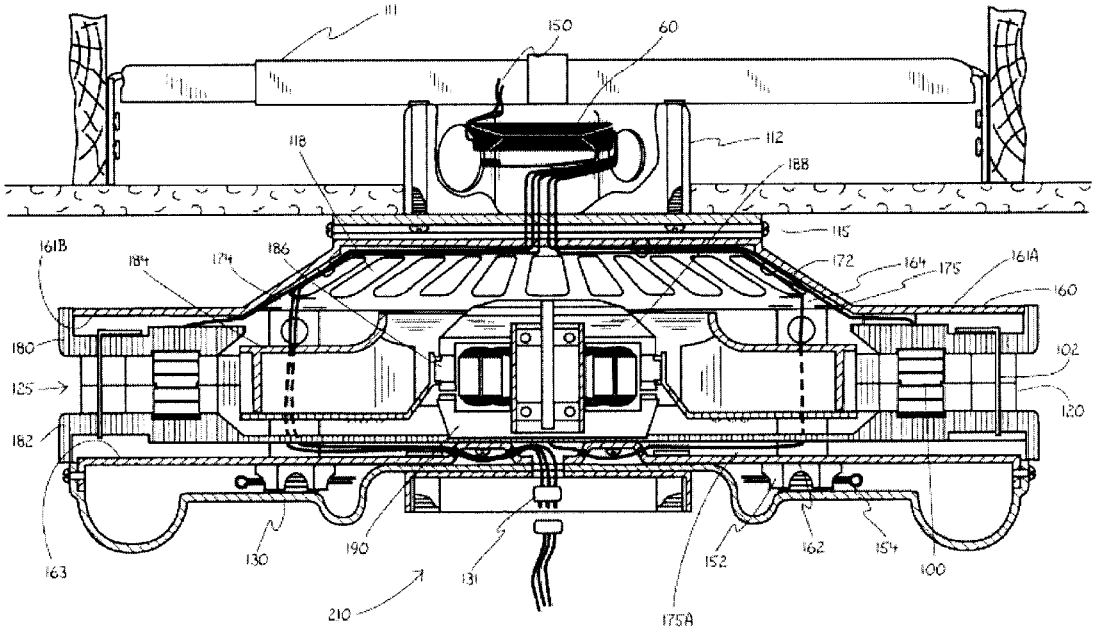
FIG. 21 is cross-sectional side view of a ceiling mounted heating device according to an alternate embodiment of the present invention showing the device in an assembled configuration.

Referring now to FIG. 21, an alternate support means 115 is shown, as are cross sectional views of device 210. A plurality of electrical conductors 150 are electrically connected to a source of electric power to provide power or the various electrical components. A preferred ceiling fan brace 111 and preferred electrical box 112 are adapted to an upward location, such as to joists in a ceiling. A preferred receiver control unit 60 may be mounted within preferred electrical box 112 or elsewhere to receive signals from a preferred transmitter control unit 247.

Preferred receiver control unit 60 controls the operation of device 210 and adapted ceiling fan 122 pursuant to the manual or automatic signal inputs from preferred transmitter control unit 247 transmitted to preferred receiver control unit 60. Electrical conductors 150 are channeled through alternate support means 115 for electrical connection with their respective electrical components. Device 210 further includes an upper preferred support plate 160 and a lower preferred support plate 162 secured to one another by a plurality of preferred pins 164. There are various methods and designs for securing upper and lower preferred support plates 160 and 162, respectively of device 210. Among them, but not limited to, are pins, bolts, studs, clamps, wires, preferred shafts, rods, adhesive, screws, etc. The preferred pin, as used throughout this specification, implies that any or all of the possible methods, described above, are within the scope of the invention. Additionally, there are various methods of securing the preferred pins, such as, for exemplary purposes only, castle nuts, nylock, cotter pins, chemical bonding and/or spring retention. Moreover, preferred castle nut 152 and cotter pin 154 combination, as used throughout this specification implies that any or all of the possible methods, described above, are within the scope of the invention. Preferred support plate 160 is attached to alternate support means 115 for attachment to preferred electrical box 112. Preferred support plate 160 may include a plurality of channels 175 formed therein for receiving conductors 172 and conductors 174, wherein conductors 172 and 174 provide electrical power to the various components.

A heat sink barrier of heat sink or heat insulative material and hereinafter referred to as a heat shield 180 is located adjacent a lower surface 161B of preferred support plate 160 to minimize heat transfer from heating elements 100 to preferred support plate 160. A preferred mirror image heat shield 182 is located adjacent an upper surface 163 of preferred support plate 162 to minimize heat transfer from heating elements 100 to preferred support plate 162. A preferred impeller 184 is mounted upon rotor 186 of a conventional electric preferred motor assembly 188. Preferred impeller 184 moves air through inlets 118 in preferred support plate 160 and exhausts the air through outlets 120 intermediate heat shields 180 and 182. A stator 190 of preferred electric motor assembly 188 is centrally mounted upon preferred support plate 162. Each of heating elements 100 is mounted at selected locations intermediate heat shields 180 and 182. A preferred screen 102 downstream of each heating element 100 is also mounted between heat shields 180 and 182 to prevent contact and injury with a respective heating element 100 as well as for decorative purposes. Preferred screen 102 is preferably perforated to permit air created by preferred impeller 184 to flow therethrough. A preferred support bracket 130 is adapted to preferred support plate 162 to adapt ceiling fan 122 thereto.

Electrical power for ceiling fan 122 is preferably routed through channels 175 within preferred support plates 160 and 162 of device 210 and through preferred support bracket 130, preferably ending in connection 131, thereby protecting and shielding electrical conductors 172 and 174 from abuse and tampering.

From the above discussion pertinent to FIG. 21, several features may be emphasized. First, the use of a common shaft to support both heating module 125 and ceiling fan 122 has been omitted. Second, device 210 is of sufficient strength and robustness to adapt ceiling fan 122. Third, the configuration and size of device 210 may be altered to conform to the specific space and power requirements attendant a room without departing from the design philosophy of device 210 as described herein.

Referring specifically now to FIGS. 21–23A–C, further details attendant device 210 will be described. Each of plurality of pins 164, such as four (4) pins 164, equiangularly spaced about support plates 160 and 162, penetrably engage aperture 140 in support plate 160 and aperture 142 in support plate 162. Pins 164 may be hollow, as depicted, and may be used in one embodiment for channeling electrical conductors 172 and 174 from channel 175 in support plate 160 to channel 175A in support plate 162. Each pin 164 includes a shoulder 144 bearing against upper surface 161A of support plate 160. Lower end 146 of pin 164 is necked down to provide a shoulder 148 seated on upper surface 163 of support plate 162. A castle nut 152 is in threaded engagement with lower end 146 of pin 164 to rigidly connect pin 164 with support plate 162. A cotter pin 154 may be used to prevent rotation of castle nut 152. From this description it will become apparent that support plate 162 is dependently supported from support plate 160 by plurality of pins 164. As discussed above, channels 175 and 175A may be formed in support plates 160 and 162, respectively, to receive a plurality of electrical conductors 172 and 174, respectively.

Figure 21A:
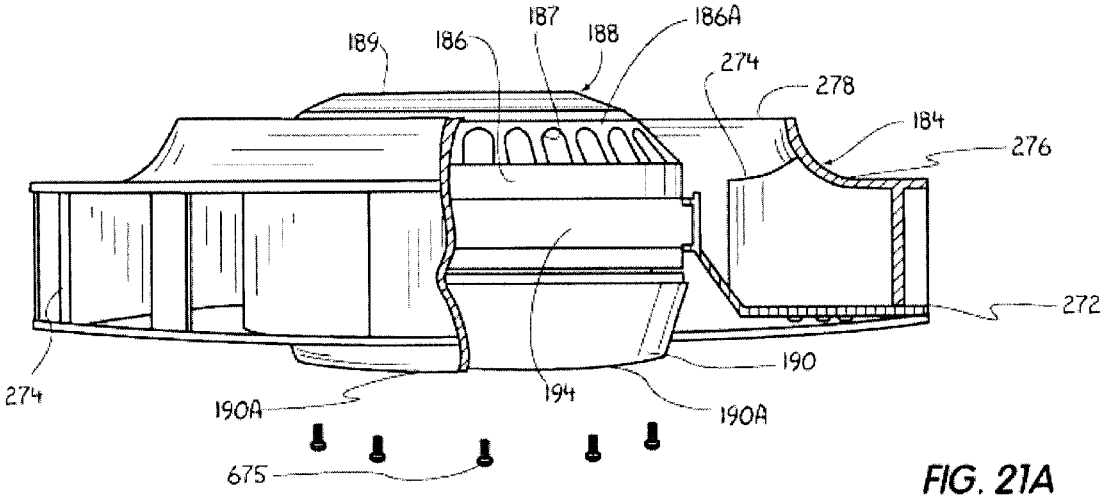
FIG. 21A is partial cross-sectional side view of an impeller of a ceiling mounted heating device according to an alternate embodiment of the present invention.

FIG. 21A is a partial cut-away view illustrating further details attendant impeller 184 and motor 188. In particular, rotor 186 includes a plurality of apertures 187 formed in the upper housing 186A; further apertures, not shown, may be formed in top central surface 189. These apertures serve the primary purpose of ventilating motor 188 to prevent a destructive heat build up.

Stator 190 of motor 188 is mounted directly to support plate 162 via insertion of preferred screws 675 through support plate 162 and into throughholes 190A of stator 190. Rotor 186 includes a mounting 194 for attachment with a cylindrical segment of base 272 of impeller 184. A plurality of curved vanes 274 extend upwardly from base 272 and are attached to an upper member 276 defining a circular opening 278, wherein circular opening 278 serves as an air inlet for impeller 184. Vanes 274, base 272 and upper member 276 may be constructed as separate components of similar or dissimilar material or molded as a single unit of the same material. It is to be understood that motor 188 and impeller 184 are commercially available from appropriate sources. It should also be noted that there are various other configurations and combinations of fan and motor assemblies such as, for exemplary purposes only, brushless motors, motors with stators and rotors, squirrel cage, blower, impeller fans and any other known means or devices that may be utilized. It should be construed that impeller 184 with its stator 190 and rotor 186 configuration as described herein to create a primary airflow could be any or all of the possible configurations described above or their equivalence and remain within the scope of the present invention.

Figures 22A, 22B:
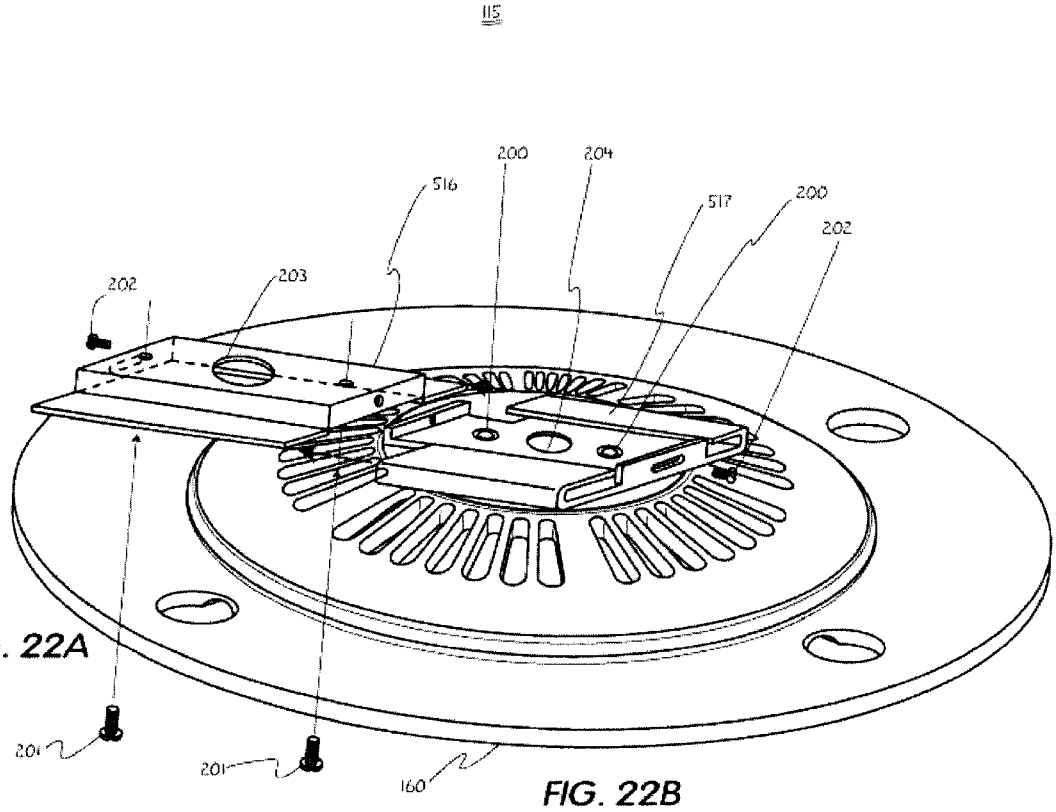
FIG. 22A and 22B is a perspective view of an alternate support means of a ceiling mounted heating device according to an alternate embodiment of the present invention.

FIGS. 22A and 22B illustrate the construction and operation of an alternate support means 115, wherein support means 115 functions to allow flush adaptation of device 210 as defined in FIGS. 20 and 21. Support means 115 is but one of many means of attachment of device 210. Those skilled in the art can readily devise alternate means, any and all of which are irrelevant to and do not affect the functionality or purpose of device 210. Support means 115 preferably comprises male support plate 516 preferably attached to preferred electrical box 112 via preferred screws 201. Female support plate 517 is preferably attached to preferred upper support plate 160 with preferred rivets 200 or alternate fasteners such as, for exemplary purposes only, screws, nuts and bolts or pins. Upon installation of device 210, electrical conductors 50 are routed through throughholes 203 and 204 prior to sliding female support plate 517 onto male support plate 516. After installation, support plates 516 and 517 are joined via screws 202 or similar fastening devices.

Figure 23A:
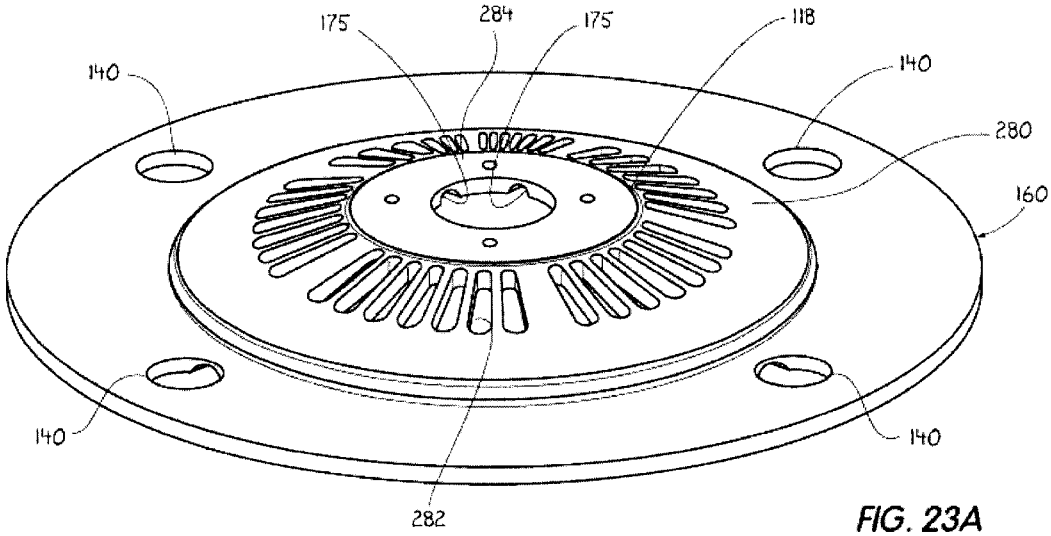
FIG. 23A is a perspective view of an upper support plate of a ceiling mounted heating device according to an alternate embodiment of the present invention.
Figure 23B:
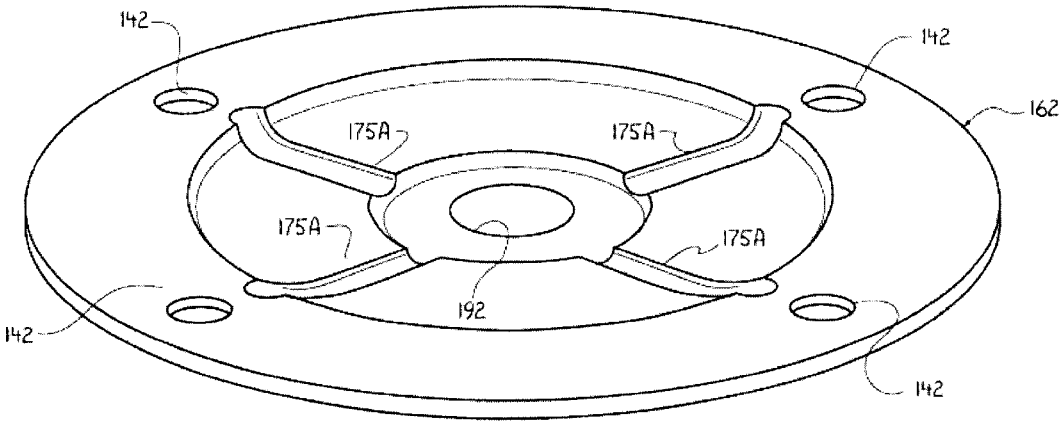
FIG. 23B is a perspective view of a lower support plate of a ceiling mounted heating device according to an alternate embodiment of the present invention.

Referring now to FIGS. 23A and 23B, support plates 160 and 162 will be described in detail. It should be noted that the top and bottom of support plates 160 and 162 are designed to allow the ingress of air, the routing of electrical conductors 172 and 174, and the support for heating elements 100, heat shields 180 and 182 and impeller 184. The design options of support plates 160 and 162 are endless and should not be limited to those shown in the attached Figures. Air is drawn through a plurality of inlets 118, wherein 42 of such inlets 118 are formed thereon; however, in alternate embodiments air can be drawn through any number or design of inlets, and wires can be routed in any direction or fashion. The design shown in the accompanying Figures represents a design that both accomplishes these requirements and enhances manufacturability, but any design that functionally meets these requirements are within the scope of the invention. Support plate 160 includes each of a plurality of apertures 140 for penetrably receiving one of pins 164. A shallow central cone section 280 includes a plurality of radial slots 282 defining inlets 118 for introducing airflow therethrough and into impeller 184 via circular opening 278. A centrally located disk section 284 preferably serves as the attaching site for alternate support means 115. A plurality of radially extending grooves or channels 175 are formed on the inside surface of support plate 160 to receive the requisite electrical conductors 172 and 174. Support plate 162 includes a plurality of apertures 142 to receive and support lower end 146 of a respective pin 164. A plurality of grooves or channels 175A are formed in support plate 162 to convey electrical conductors 172 and 174 beneath optional disk 92, if present, and through aperture 192.

Figure 23C:
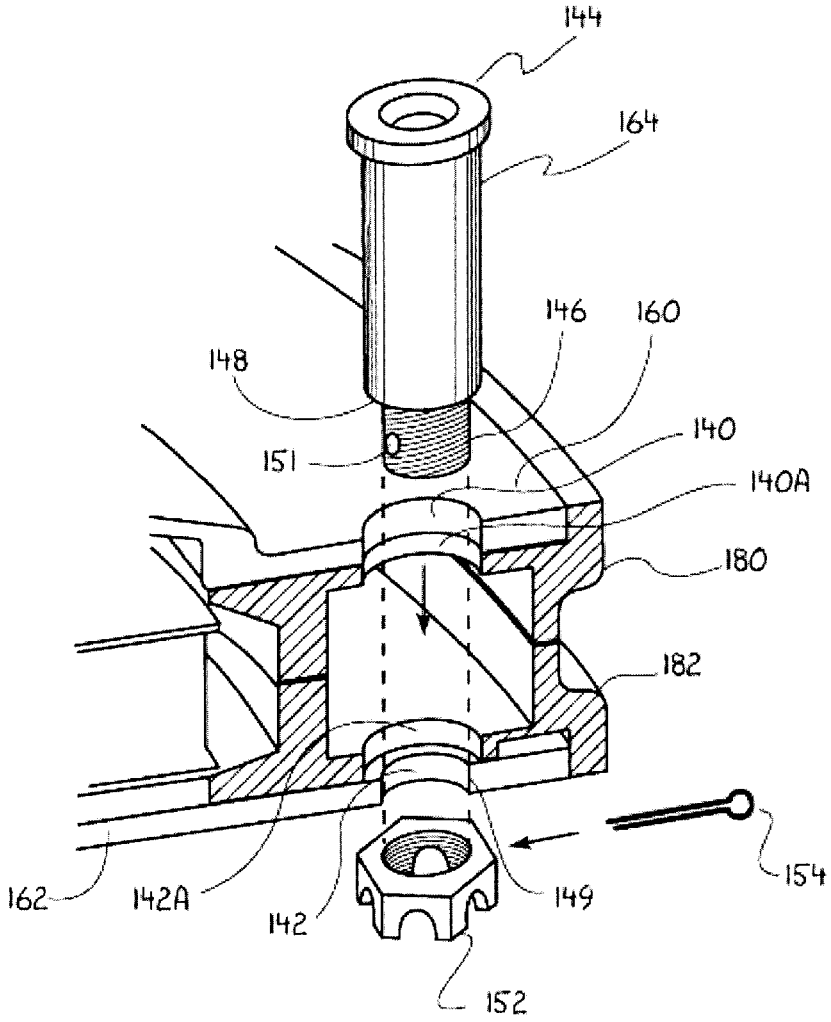
FIG. 23C is a perspective view of pin of a ceiling mounted heating device according to an alternate embodiment of the present invention.

Details of each of pins 164 will be described with particular reference to FIG. 23C. Pin 164 extends through aperture 140 in support plate 160 and through aperture 140A in heat shield 180. Similarly, pin 164 extends through aperture 142A in heat shield 182 and aperture 142 in support plate 162. Shoulder 148 of pin 164 is supported by support plate 162. Castle nut 152 engages the threads of the necked down section of lower end 146 of pin 164. Cotter pin 154 penetrably engages castle nut 152 and passageway 151 in pin 164.

Figure 24A:
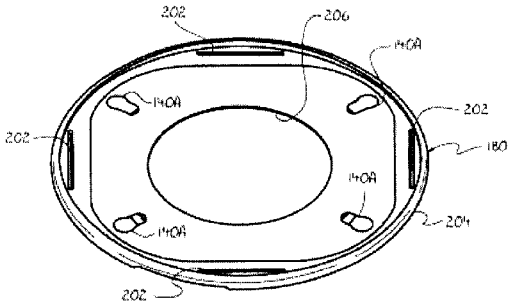
FIGS. 24A, 24B, 24C and 24D are perspective views of the heat shields of a ceiling mounted heating device according to an alternate embodiment of the present invention.
Figure 24D:
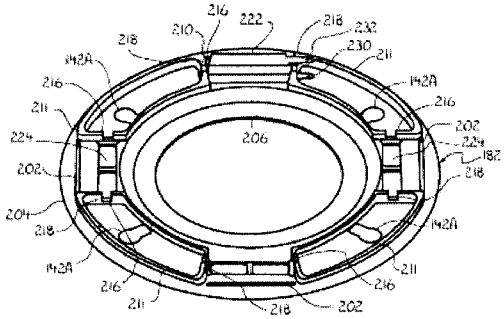
Figure 24B:
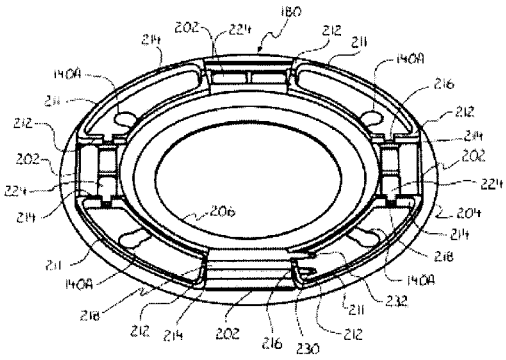

Referring jointly to FIGS. 24A, 24B, 24C and 24D, details attendant heat shields 180 and 182 will be described in detail. Heating module 125 as utilized in the design of device 210, further comprises heat shields 180 and 182, wherein heat shields 180 and 182 support heating elements 100 and protective screens 102. Although thermally insulative material, such as high temperature plastic or ceramic, is the material of choice for heat shields 180 and 182, there are various other methods and materials contemplated for isolating heating elements 100 from components of device 210 affected by adverse heat. Among them, but not limited to, are other thermally insulative materials, heat sink heat shield materials, reflective materials and distance from adjacent components and their equivalence. There are also various electric heating elements that may serve the same purpose. Among them, but not limited to, are PTC, ceramic, coiled wire or any other known method or materials including their equivalence. Denying consumer access, as a safety precaution, to heating elements 100 can be performed in various ways. Among them, but not limited to, are screens, bars, molded plastic, wire mesh or any other known methods or devices including their equivalence. It should be construed that the heat shields 180 and 182, heating elements 100 and screens 102 as used in this specification implies that any or all of the possible elements, listed above and their equivalence, are within the scope of the invention. FIG. 24A illustrates the top side of heat shield 180, wherein heat shield 180 has a plurality of apertures 140A for receiving a respective one of pins 164. A plurality of slots 202 are formed therein for penetrably mounting a respective one of screens 102. A circumferential lip 204 extends about the perimeter for receiving the edge of support plate 160. A centrally positioned aperture 206 is formed to provide unimpeded airflow through slots 282 in support plate 160. The underside of heat shield 180 is shown in FIG. 24B, wherein a plurality of generally trapezoidal-shaped walls 211 are disposed generally centered upon apertures 140A and extend downwardly therefrom (it is to be noted that FIG. 24B illustrates the bottom side of heat shield 180). Wall sections 212 and 214 are generally radially aligned and include slots 216 and 218, respectively, formed therein. Slots 216 and 218 are provided to support tabs 230 and 232 extending from heating elements 100/222, of which one such heating element 222 is shown mounted in place.

Figure 24C:
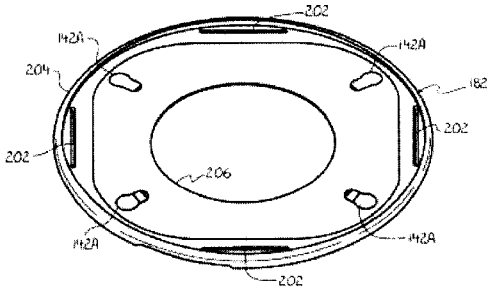

FIGS. 24C and 24D illustrate the bottom and top surfaces, respectively, of heat shield 182. Heat shield 180 and 182 are identical to one another and common reference numerals have been used to identify corresponding elements.

Upon mounting heat shield 180 upon heat shield 182, apertures 140A and 142A and slots 202 of heat shields 180 and 182 will be vertically aligned with one another. Similarly, walls 211 will be aligned with one another in contacting relationship to provide an essentially closed airspace therewithin to prevent heat transfer to pins 164 extending through apertures 140A and 142A and to channel air created by preferably motorized impeller 184 through heating elements 100/222. Furthermore, heat shields 180 and 182 are formed from heat insulative material, and will serve as a heat barrier to reduce heat transfer from heating elements 100/222 to support plates 160 and 162 and other elements adjacent heat shield 180 and 182. The outflow of air through heating elements 100/222 induced by motorized impeller 184 will reduce heat flow radially inwardly from heating elements 222 to impeller 184 and its motor 188. Screens 102, mounted within slots 202, shield heating elements 222 against inadvertent or deliberate contact to prevent damage and/or injury. Aperture 206 of heat shield 182 is generally coincident with the perimeter of optional disk 192, if present, located centrally of support plate 162.

Figure 25:
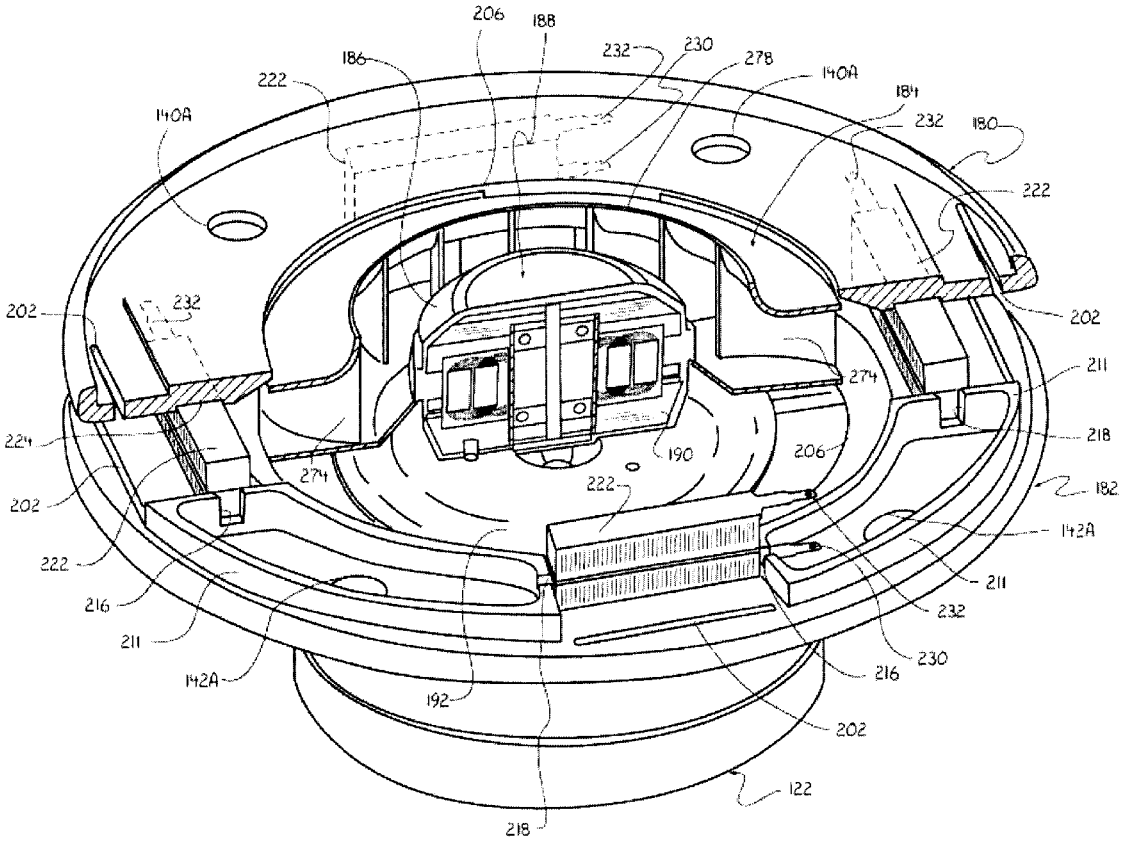
FIG. 25 is a partial cut-away, isometric view of the heating module of a ceiling mounted heating device according to an alternate embodiment of the present invention.

FIG. 25 illustrates a partial cut-away view showing the structures intermediate heat shields 180 and 182. Various heat shield designs were evaluated to perform three basic functions: support heating elements 222; prevent the transfer of heat between heating elements 222 and proximate components; and the channeling of the primary airflow. The design in FIG. 25 is but one of many ways to accomplish these tasks. Among those designs evaluated but not limited to were, metal structures with heat sink inserts, full heat sink structure, open architecture and combinations thereof. The chosen design lent to ease of manufacturability but all of the designs, listed above and their equivalence, are within the scope of the invention. More particularly, FIG. 18 shows each of four (4) heating elements 222 retained equiangularly intermediate heat shields 180 and 182. Each of heat shields 180 and 182 includes a depression 224 for nestingly receiving the body of a heating elements 222 (the exposed ones of these depressions are also shown in FIGS. 24B and 24D). Optional disk 192, disposed centrally of opening 206, supports stator 190, and rotor 186 of motor 188 supports impeller 184. It is noted that opening 206 in heat shield 180 is generally coincident with the perimeter of impeller 184. Upon inspection it will become evident that as air is drawn through circular opening 278 of impeller 184, such air flows past motor 188 and will have a cooling effect thereon. The air exhausted by vanes 274 of impeller 184 will be channeled proximal to wall sections 211 of heat shields 180 and 182 and through each of heating elements 222. As described more fully below, some or all of heating elements 222 may be energized and those that are will raise the temperature of the air flowing therethrough. Each of heating elements 222 includes tabs 230 and 232, wherein tabs 230 and 232 are located within respective ones of slots 216 and 218 in wall sections 211 of each of heat shields 180 and 182. As such, retention of heating elements 222 is enhanced by locking action resultant from tabs 230 and 232 being disposed within their respective slots 216 and 218.

Figure 26:
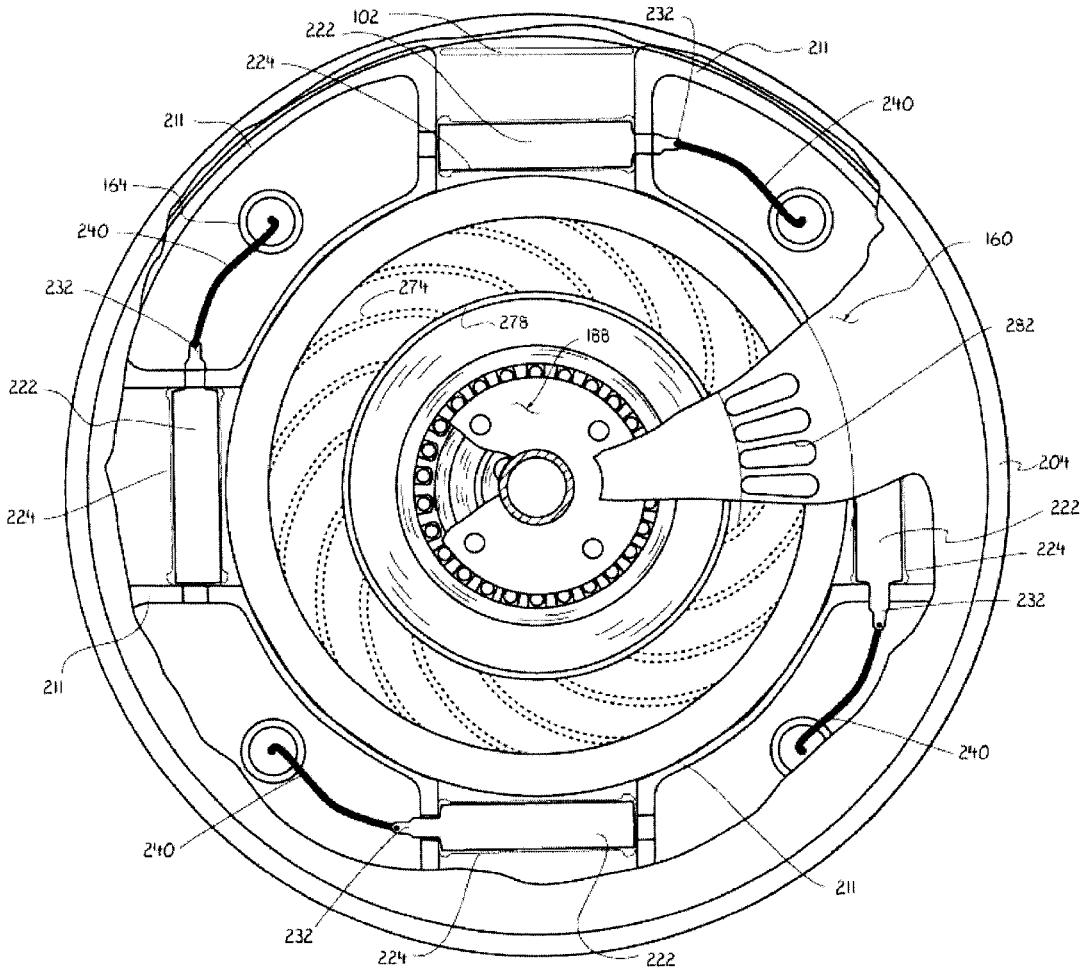
FIG. 26 is a partial cross-sectional top view of a ceiling mounted heating device according to an alternate embodiment of the present invention.

FIG. 26 is a top partial cut-away view of heating module 125 showing the relationships of the various elements disposed therein. Support plate 160 is partially shown along with slots 282 formed therein and the top of pin 164. The perimeter of upper support plate 160 is nestled within lip 204 of heat shield 180. As illustrated, electrical conductors 240 are electrically secured to tabs 230 and 232 (of which only tab 232 is shown) and routed through a central passageway extending through pin 164 as an alternative. Electrical conductors 240 are routed to heating elements 222 via channels disposed in support plate 160. An apertured screen 102 is mounted within its slots 202 to prevent physical contact with heating element 222 upstream therefrom. It may also be noted that wall sections 211 on opposed sides of the ends of each heating elements 222 in combination with the connecting surfaces of each heat shield 180 and 182 define the passageway for exhausting the heated primary airflow induced by impeller 184.

Figure 27:
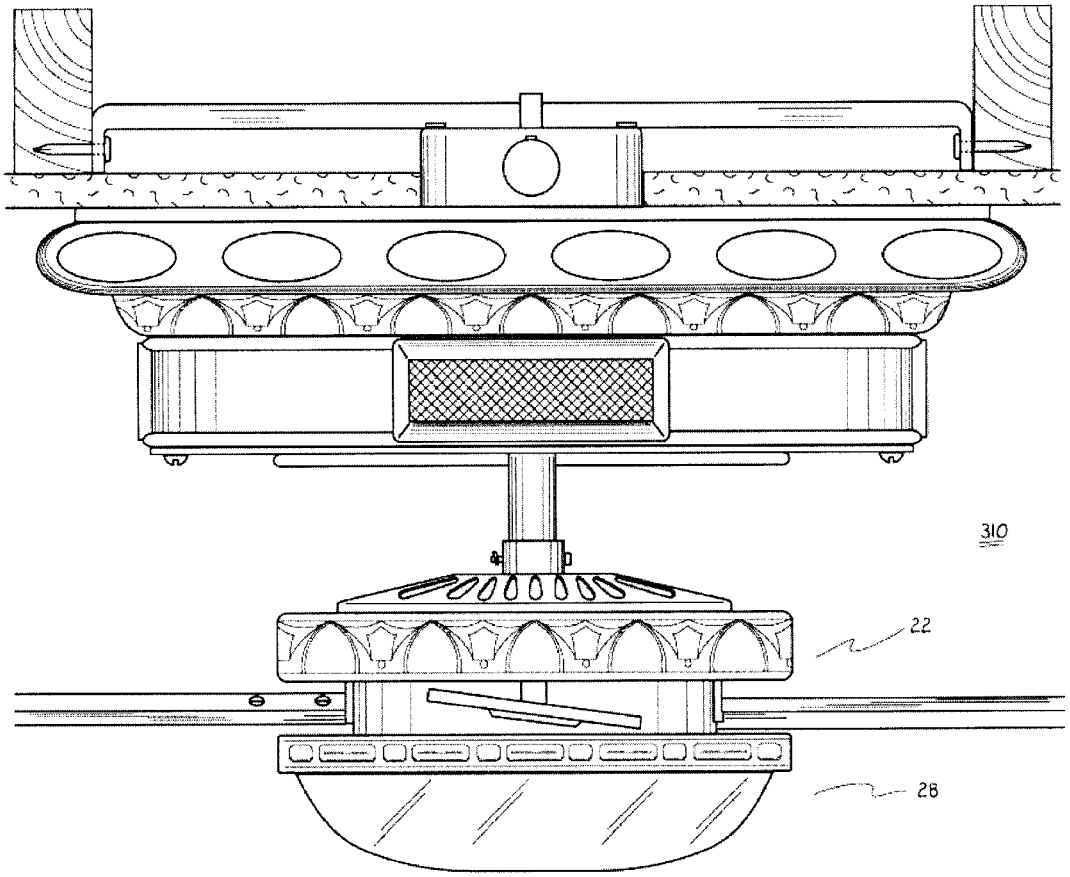
FIG. 27 is a side view of a ceiling mounted heating device according to an alternate embodiment of the present invention showing a ceiling fan adapted thereto.

FIG. 27 illustrates yet another embodiment of device 310 shown with optional decorative elements or housings. It is to be understood that the exterior configuration illustrated is simply one of a multitude of decorative exterior configurations that may be used. This particular embodiment does not support ceiling fan 22, but rather adapts adjacent the ceiling in proximity to ceiling fan support means 225. In the embodiment depicted in FIG. 27, device 310 does not disturb the location or functionality of ceiling fan 22.

Figure 28:
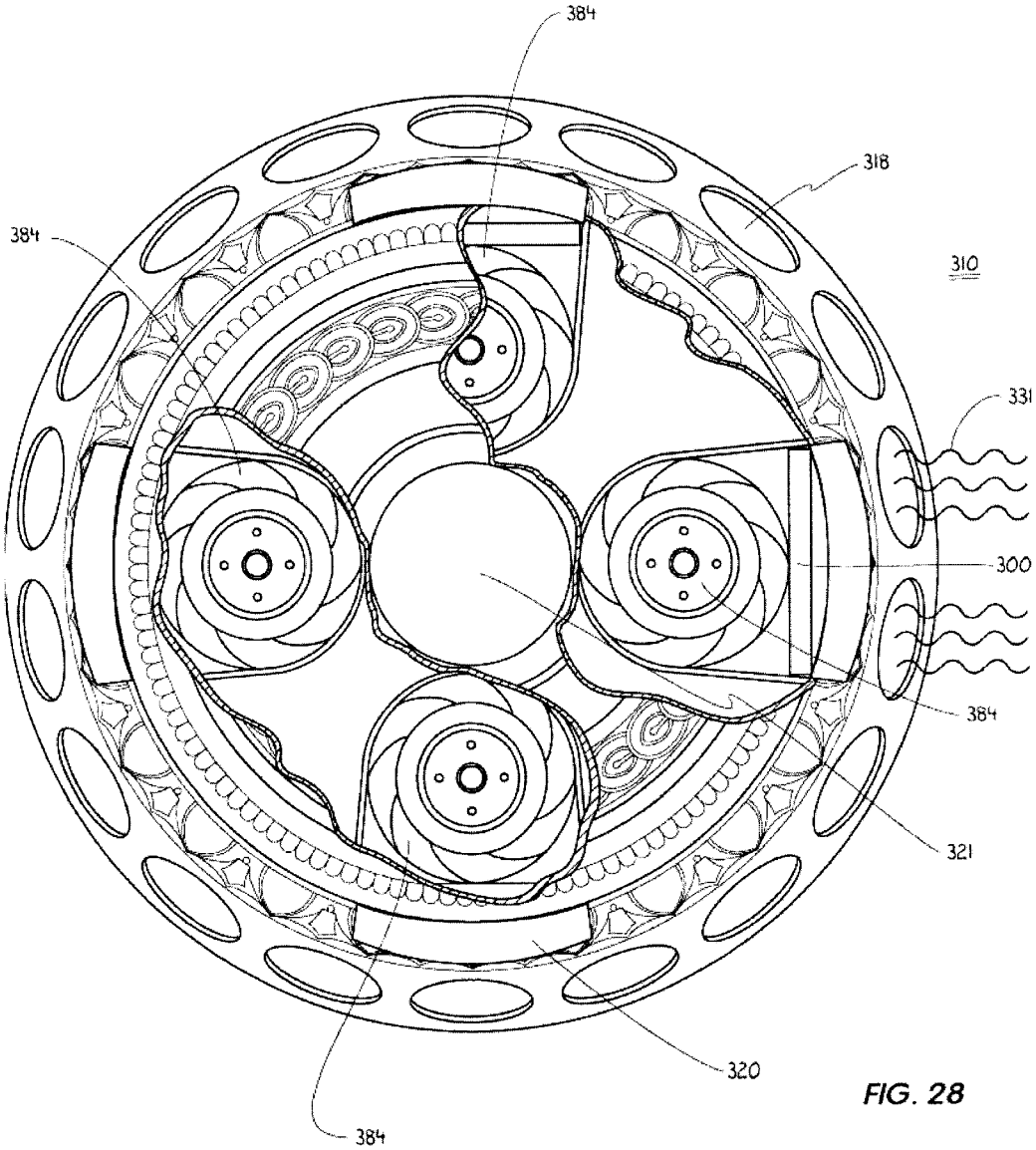
FIG. 28 is a partial cross-sectional top view of a ceiling mounted heating device according to an alternate embodiment of the present invention.

Referring now to FIG. 28, device 310 adapts in an upward location of ceiling fan 22 and has an opening 321 for ceiling fan support means 225 to pass through. Device 310 provides a heated airflow to integrate with the airflow already created by ceiling fan 22. Device 310 contains inlet 318 for moving air into device 310 to be heated. The air is moved through device 310 as a result of the energization of preferred impellers 384 that further urge the air through heating elements 300 to create a primary heated airflow 331. Primary heated airflow 331 is then exhausted from device 310 through outlets 320. It is recognized in an alternate embodiment that device 310 may incorporate any number of inlets 318 and outlets 320.

Figure 29:
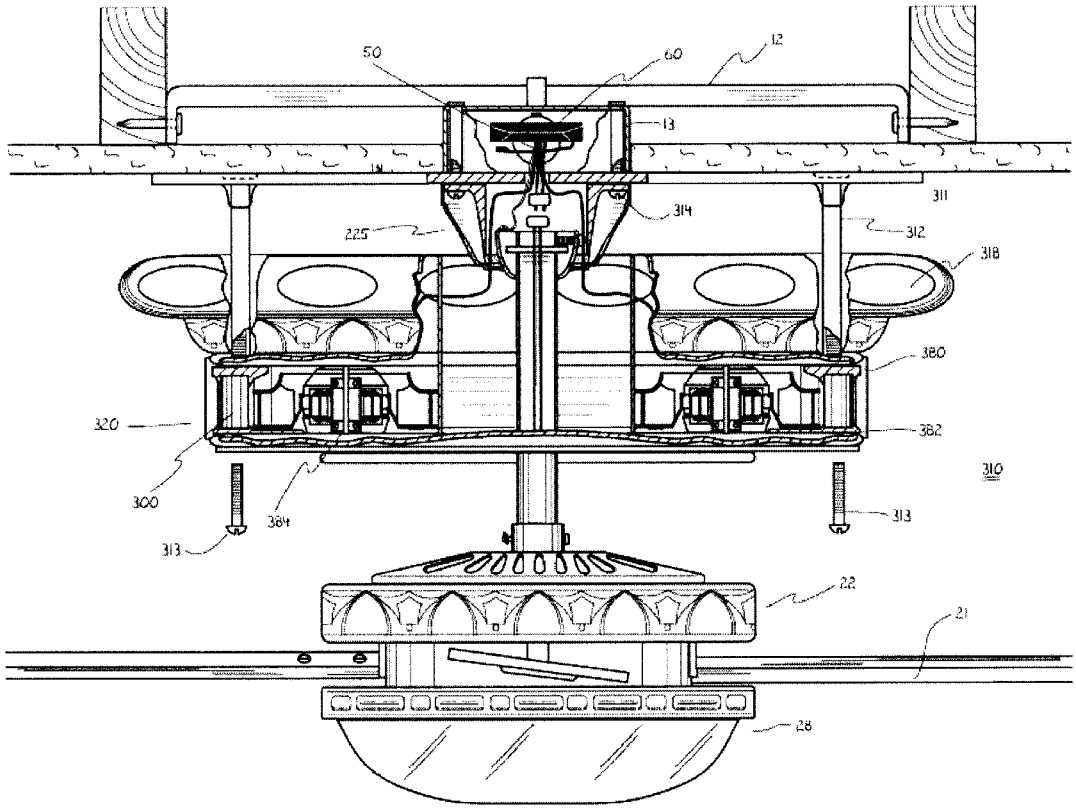
FIG. 29 is a cross-sectional side view of a ceiling mounted heating device according to an alternate embodiment of the present invention showing the device in a disassembled configuration.

Referring now to FIG. 29, device 310 could comprise like components from previous embodiments and function in a similar manner. Such components could include preferred ceiling fan brace 12, preferred electrical box 13, ceiling fan 22, optional light module 28, electrical conductors 50, preferred receiver control unit 60, preferred impellers 384, heating elements 300, inlets 318, outlets 320, heat shield 380 and heat shield 382. Alternatively, as shown FIG. 29, the current embodiment of device 310 does not support ceiling fan 22, but rather device 310 adapts to an upward location, preferably the ceiling of a room. In addition, ceiling fan 22 could retain a support means 225. It should be noted that since alternate embodiment 310 does not support ceiling fan 22, adaptation to a ceiling could be through multiple methods such as, for exemplary purposes only, screws, nuts and bolts, nails or adhesives. As an added measure of safety, device 310 can be adapted to a ceiling by attaching preferred support plate 311 to preferred electrical box 13 with screws 314. Screws 314 also function to adapt support means 225 to preferred electrical box 13. A plurality of preferred pins 312 are adapted to preferred support plate 311 to provide adaptation of device 310. Preferred screws 313 engage preferred pins 312 and secure device 310 to preferred support plate 311.

Figure 30:
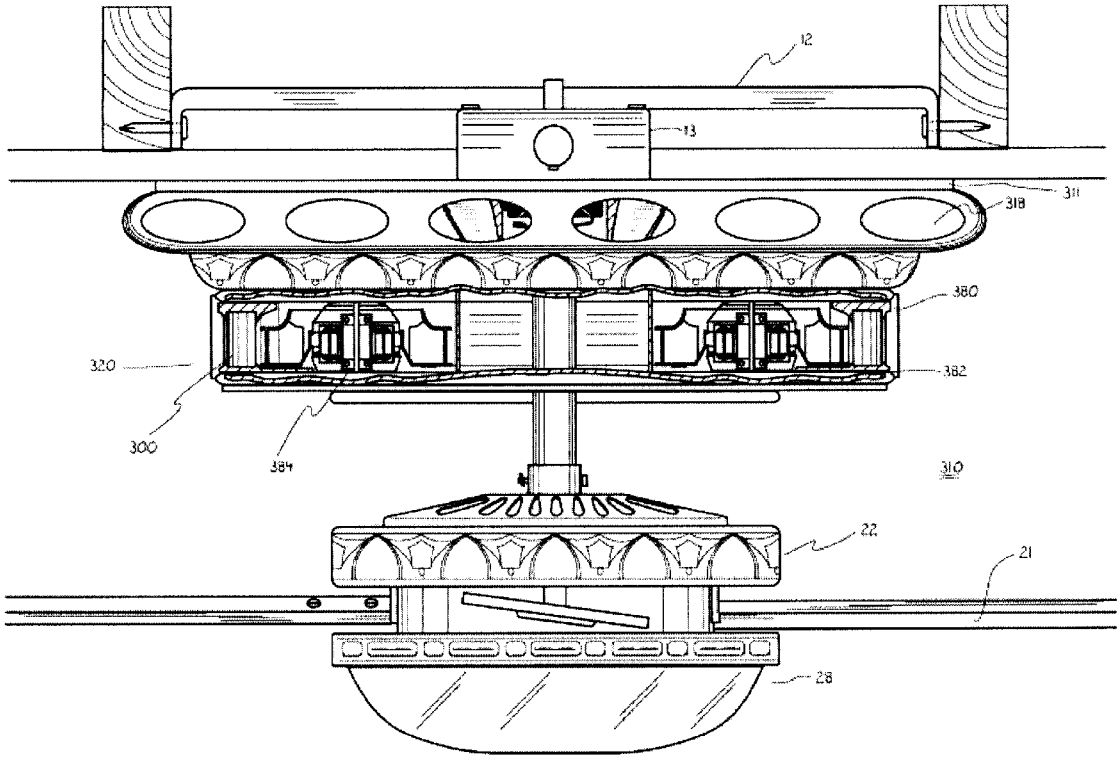
FIG. 30 is a cross-sectional side view of a ceiling mounted heating device according to an alternate embodiment of the present invention showing the device in an assembled configuration.

Referring now to FIG. 30, there is illustrated an alternate embodiment of a device 310 mounted in proximity to ceiling fan 22 and optional lighting module 28.

Figure 31:
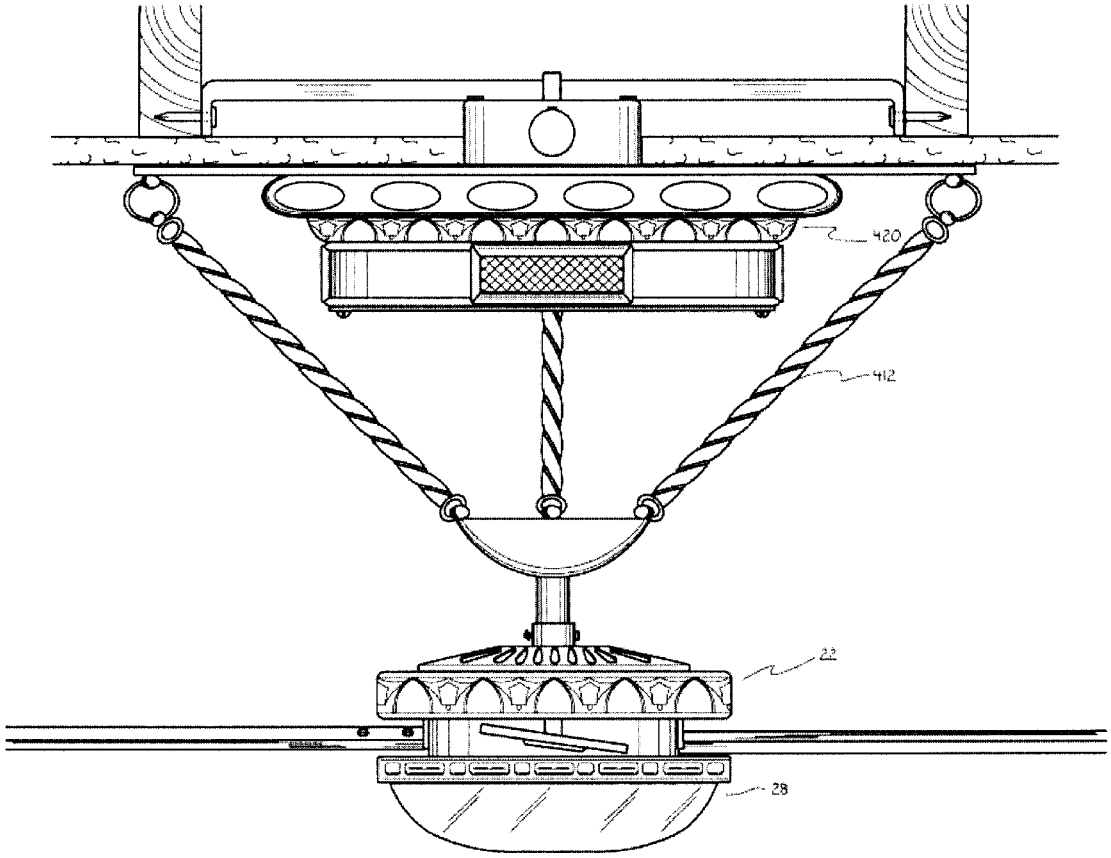
FIG. 31 is a side view of a ceiling mounted heating device according to an alternate embodiment of the present invention showing a ceiling fan adapted thereto.

Referring now to FIG. 31, there is illustrated an alternate design for mounting a device 420 in proximity to ceiling fan 22 and optional light kit 28. Variations of a decorative rod support kit 412 are known in the fan industry and are alternate means for mounting ceiling fans. FIG. 31 is shown to support the postulate that those skilled in the art may construct the same device with a variety of decorative options that perform the same function. It is intended that all combinations of elements and steps that perform substantially the same function in substantially the same way to achieve substantially the same result, be within the scope of this invention.

Figure 32:
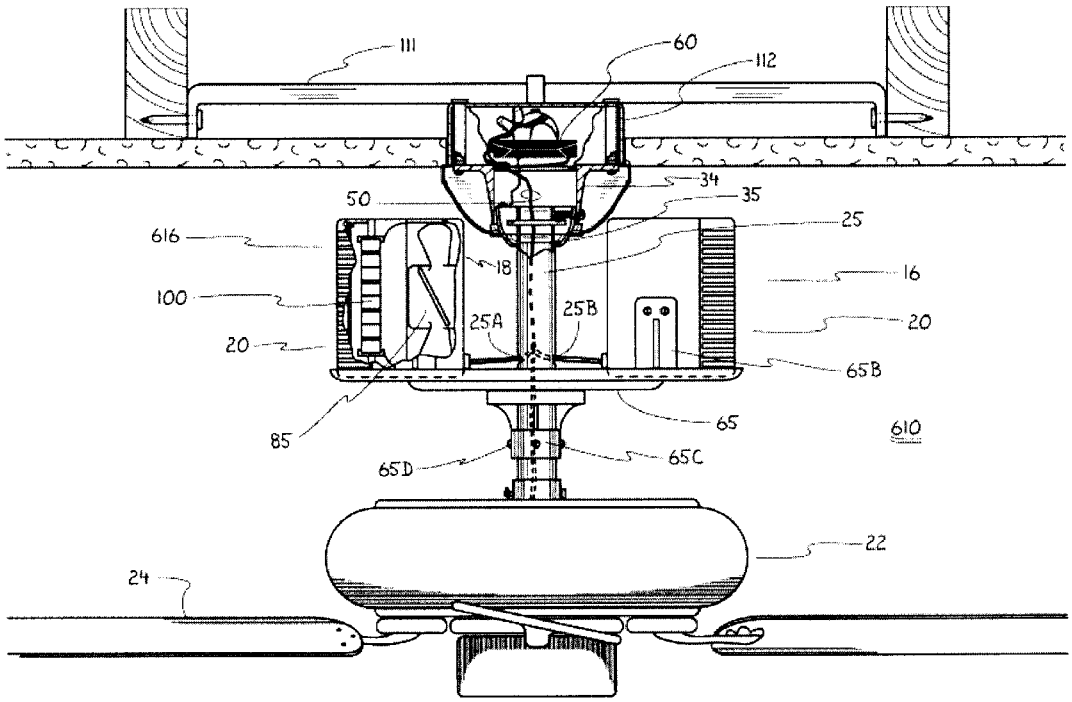
FIG. 32 is a cross-sectional side view of a ceiling mounted heating device according to an alternate embodiment of the present invention showing one or more heating devices mounted to the downrod of a ceiling fan.

Referring now to FIG. 32, therein is illustrated an alternate embodiment of the device 610. This embodiment portrays a ceiling fan 22 conventionally mounted to a preferred ceiling fan brace 111. Moreover, electric box 112 is connected to a standard electrical power source, such as 120/220AC, to supply power to preferred remote control receiver 60 and, via conductors 50, to associated electrically powered components. Attached to electric box 112 is standard ceiling fan hanger bracket 34, wherein hanger bracket 34 cradles standard hanger ball 35 conventionally attached to downrod 25, thereby completing the supporting mechanism for ceiling fan 22. In this embodiment ceiling fan downrod 25 is replaced with another downrod having apertures 25A and 25B for the further routing of conductors 50 to heating module 616. Attached to downrod 25 is a preferred mounting plate 65 with preferred attached collar 65C secured to downrod 25 by preferred setscrews 65D. A bracket 65B extends from mounting plate 65 to secure heating modules 616. Heating modules 616 perform the task of directing heated airflow into the path of a preferably upward airflow created by ceiling fan 22 and ceiling fan blades 24. This preferably upward airflow directs the mixed warm air first against the ceiling then into circulation down the walls, across the floor and back again into circulation. Heating modules 616 create this heated airflow by first drawing air through inlet 18 (not shown) in response to rotation of a motorized fan 85. The resultant airflow is then directed past heating elements 100 prior to being exhausted for mixing with the preferred upward airflow created by ceiling fan 22. Preferred remote control receiver 60 receives transmissions from either a remote or hard-wired device as explained previously in this specification in previous embodiments.

Figure 33:
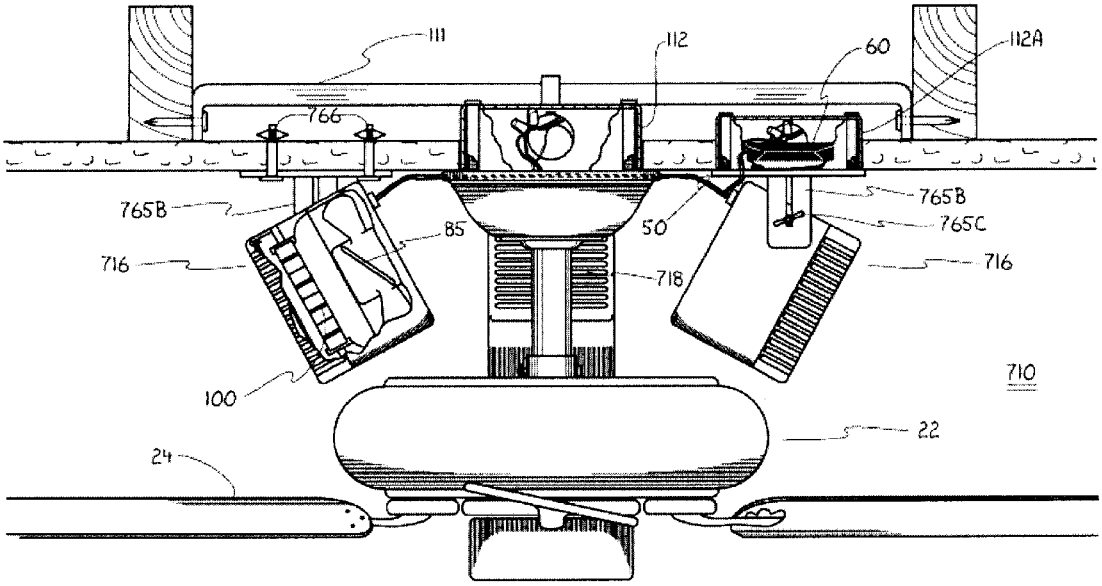
FIG. 33 is a cross-sectional side view of a ceiling mounted heating device according to an alternate embodiment of the present invention.

FIG. 33 illustrates another alternate embodiment of device 710 showing heating modules 716 mounted independently of ceiling fan 22. The association between the heating modules 716 and ceiling fan 22 has no mechanical interface and is functional only. Ceiling fan 22 is conventionally mounted to a preferred ceiling fan brace 111 and electrical box 112. Heating modules 716 can be independently and upwardly attached within the furthest arc created by blades 24 of ceiling fan 22 and can be mounted as a single unit or in multiples depending on the amount of heating required. In the present alternate embodiment, primary heating module 716 is mounted to a preferred electrical box 112A via preferred brackets 765B and preferred wing nut or conventional nut 765C. Electrical box 112A houses preferred remote control receiver 60 and is further connected to a typical 120/220AC household current. Further, heating modules 716 can be mounted using a variety of attachment means including, screws, nuts and bolts, adhesives and/or expansion screws 766. Preferred remote control receiver 60 is activated by a preferred hand-held device as previously explained in this specification or hardwired to receive controls that direct the amount of heat produced by heating module 716. In this embodiment ceiling fan 22 is controlled by conventional means as supplied by the manufacturer of ceiling fan 22. Electrical conduit 50 provides the electrical power to activate motorized fan 85 and heating elements 100. Heated airflow is created in response to the rotation of at least one motorized fan 85 drawing air through inlet 718 and then forcing the created airflow through heating element 100. The heated airflow is thereafter exhausted through outlet 20 for mixing with the preferred upward flow of air created by ceiling fan 22.

In summary, the present invention includes a ceiling mounted heating device mounted independently of and designed to work in association with a ceiling fan, wherein such a configuration creates a reheated airflow and circulates the reheated airflow throughout a room. The heating device, through different embodiments, may either support a ceiling fan or, alternatively, mount upwards in the proximity of a ceiling fan.

It should be noted that although a ceiling fan is the preferred work piece, any distribution fan capable of generating a preferred upward airflow may be utilized in association with the present apparatus, system and/or method.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

I claim:

1. A heating device for heating a room, said heating device mountable independently of and designed to work in association with a ceiling fan, wherein the ceiling fan produces a secondary airflow, said heating device comprising in combination:

a) means for producing a primary heated airflow; and b) means for introducing said primary heated airflow into the secondary airflow created by the ceiling fan.

2. The heating device as set forth in claim 1, wherein said means for producing a primary heated airflow comprises in combination:

a) at least one support means;

b) at least one motor having at least one fan blade adapted for creating an airflow; and c) at least one heating element for heating said airflow.

3. The heating device as set forth in claim 1, wherein said means for introducing said heated airflow comprises in combination:

a) at least one inlet for introducing air to create said airflow; and b) at least one outlet for exhausting said primary heated airflow, wherein said at least one outlet is positioned proximal to the secondary airflow created by the ceiling fan.

4. The heating device as set forth in claim 2 further comprising a heat shield material for reducing the transfer of heat between said at least one heating element and proximate elements.

5. A heating device for heating a room mountable independently of and becoming a recirculating system when working in association with a ceiling fan, wherein the ceiling fan produces a secondary airflow, said heating device comprising in combination:

a) at least one means for attaching said heating device to an upward location;

b) at least one motor having at least one fan blade for creating a primary airflow;

and c) at least one heating element for heating said primary airflow.

6. The heating device as set forth in claim 5 wherein said primary heated airflow mixes with the secondary airflow created by the ceiling fan.

7. The heating device as set forth in claim 5 further comprising at least one inlet for introducing air to be heated.

8. The heating device as set forth in claim 5 having at least one outlet for exhausting said heated primary airflow.

9. A heating and reheating device for heating a room, mountable independently of and designed to work in association with a ceiling fan, wherein the ceiling fan produces a secondary airflow, said device comprising in combination:

a) at least one support;

b) means for producing a heated primary airflow;

c) means for discharging said heated primary airflow from said device; and d) means for regulating the amount of heat created by said device, wherein said means for producing a heated primary airflow, said means for discharging said heated primary airflow and said means for regulating the amount of heat are carried by said support.

10. The heating and reheating device as set forth in claim 9 wherein said device is mounted separately from the ceiling fan.

11. The heating and reheating device as set forth in claim 9 wherein said device is adapted to removably receive and support the ceiling fan.

12. The heating and reheating device as set forth in claim 9 wherein said means for discharging heat comprises:

a) at least one inlet for introducing air to be heated;

b) at least one motorized fan for generating an airflow;

c) at least one heating element for heating said airflow; and d) at least one outlet for discharging said heated primary airflow.

13. The heating and reheating device as set forth in claim 9 wherein said means for regulating the amount of heat is adjustable to maintain a desired temperature within the room.

14. The heating and reheating device as set forth in claim 9 wherein said means for regulating the amount of heat is manually adjustable to set a desired temperature and then automatically regulates the heat produced to maintain said desired temperature.

15. A heating and recirculating system that comprises a heating module adapted to receive and to work in association with a ceiling fan, comprising in combination;

a) at least one support means;

b) a heating module comprising;

i. at least one inlet for introducing air to be heated;

ii. at least one motorized fan for creating an airflow;

iii. at least one heating element for heating said airflow and creating a heated airflow; and iv. at least one outlet for exhausting said heated airflow;

c) means for adapting the ceiling fan with said heating module; and d) means for isolating said at least one heating element from the ceiling fan.

16. The heating and recirculating system as set forth in claim 15 wherein the heated airflow produced by said heating module mixes with the upward airflow created by the ceiling fan for near uniform distribution throughout the room.

17. A heating and reheating device mounted to an upward location for heating a room, said heating device adapted to receive, support and work in association with a ceiling fan, said heating device comprising in combination:

a) at least one support means;

b) at least one heating module comprising:

i. an inlet for introducing air to be heated;

ii. at least one motor with at least one attached fan blade for drawing air through said inlet and creating an airflow to be heated;

iii. at least one heating element for heating said airflow and creating a heated airflow; and iv. at least one outlet for exhausting said heated airflow to be mixed for distribution with the airflow created by the ceiling fan;

c) means for receiving and supporting the ceiling fan;

d) means for selectively regulating said at least one heating element, wherein said means for selectively regulating is responsive to at least one input for regulating the temperature of said heated airflow to be mixed for distribution by the airflow created by the ceiling fan; and e) a heat sink barrier for reducing the transfer of heat between said at least one heating element and proximate elements.

18. The heating and reheating device as set forth in claim 17 wherein said means for selectively regulating said at least one heating element is adjustable to maintain a desired temperature within the room.

19. The heating and reheating device as set forth in claim 17 wherein said means for selectively regulating said at least one heating element is manually adjustable to set a desired temperature and then automatically regulates the heat produced to maintain said desired temperature.

20. A heating device for functioning in association with an upward airflow created by a ceiling fan, said heating device mounted independently of and separate from the ceiling fan, said heating device comprising:

a) at least one support means for supporting said heating device; and b) at least one heating module for creating a heated airflow mounted proximate the upward airflow created by the ceiling fan.

21. The heating device as set forth in claim 20 wherein the heating module is located above the ceiling fan and within the circumferential area of the ceiling fan blades.

22. The heating device as set forth in claim 20 wherein said heated airflow immediately mixes with the upward flow of air created by a ceiling fan for distribution throughout the room.

23. A heating device adapted to receive and secure the support system of a ceiling fan, said heating device capable of working in association with the ceiling fan to heat a room, said heating device comprising in combination:

a) at least one attachment means for attaching said support system to said heating device;

b) at least one heating module comprising:

i. at least one motorized fan for creating an airflow to be heated; and ii. at least one heating element for heating said airflow to create a heated airflow for mixing with the airflow created by the ceiling fan, said at least one heating element isolated from the ceiling fan.

24. The heating device as set forth in claim 23 wherein said at least one heating module has a top surface and a bottom surface, and wherein said attachment means is carried at said bottom surface of said attachment means such that the ceiling fan is positioned below said heating module when attached by said attachment means.

25. The heating device as set forth in claim 23 wherein said at least one heating module further comprises means for regulating the amount of heat created by said at least one heating element to create a desired room temperature.

26. The heating device as set forth in claim 23 having at least one inlet for introducing air to be heated.

27. The heating device as set forth in claim 23 having at least one outlet for exhausting the heated airflow for mixing with the airflow created by the ceiling fan.

28. A heating system for heating a room, said heating system independently mounted from and working in association with a ceiling fan to mix heated airflow with the circulatory airflow of the ceiling fan to heat a room, comprising:

a) means for supporting said heating system;

b) at least one inlet for introducing air into said heating system;

c) at least one motorized fan for creating an airflow to be heated;

d) at least one heating element for heating said airflow; and e) at least one outlet for exhausting said heated airflow into the path of an upward flow of air created by the ceiling fan.

29. The heating system as set forth in claim 28 wherein said means for supporting said heating system is independent of and separate from any support means associated with the ceiling fan.

30. The heating-system as set forth in claim 28 further comprising separate and independent control means for controlling said heating device.

31. The heating system as set forth in claim 28 further comprising control means for controlling both said heating device and the ceiling fan.

32. A method for heating a room with a heating device mounted independently from and working in association with a ceiling fan, comprising the steps of:

a) moving air through at least one inlet of a heating module, induced by the rotation of at least one motor and at least one fan blade, then urged through at least one heating element for heating the created airflow; and b) mixing said created heated airflow with the upward flow of air from the ceiling fan for near uniform distribution throughout a room.

33. A heating device for heating a room, said heating device designed to work in association with a ceiling fan having blades, wherein the ceiling fan produces a secondary airflow, said heating device comprising in combination:

a) at least one support means that positions said heating device upwards of the ceiling fan and within the circumferential area defined by the outside radius of the ceiling fan blades;

b) means for producing a primary heated airflow to be circulated by the blades of the ceiling fan;

c) means for introducing said primary heated airflow into the secondary airflow created by the ceiling fan; and d) means for isolating said means for producing said primary heated airflow from the ceiling fan.

34. The heating device as set forth in claim 33, wherein said means for producing said heated airflow comprises in combination:

a) at least one inlet for introducing air to be heated;

b) at least one motor with at least one adapted fan blade for drawing air through said at least one inlet;

c) at least one heating element for heating said introduced air; and d) at least one outlet for exhausting said heated airflow for distribution by the ceiling fan.

35. The heating device as set forth in claim 34 wherein said isolating means is a heat shield material for reducing the transfer of heat between said at least one heating element and proximate elements.

36. The heating device as set forth in claim 33 further comprising means for regulating the amount of heat, wherein said means for regulating is adjustable to maintain a desired temperature within the room.

37. The heating device as set forth in claim 36 wherein said means for regulating the amount of heat is manually adjustable to set a desired temperature and then automatically regulates the heat produced to maintain said desired temperature.

38. A heating and reheating device for heating a room mounted independently of and becoming a recirculating system when working in association with a ceiling fan, wherein the ceiling fan produces a secondary airflow, said heating device comprising in combination:

a) at least one means for attaching said heating device to an upward location;

b) at least one motor having at least one fan blade for creating a primary airflow;

c) at least one inlet for introducing air to be heated;

d) a plurality of heating elements arranged in a juxtaposed configuration to first heat the incoming air and then reheat said heated air to produce higher air temperature; and e) at least one outlet for exhausting said heated airflow into the path of the airflow created by the ceiling fan.

39. The heating and reheating device as set forth in claim 38 wherein the heated airflow produced by said heating device mixes with the upward airflow created by the ceiling fan for near uniform distribution throughout the room.

40. The heating and reheating device as set forth in claim 38 further comprising means for regulating the amount of heated airflow to be mixed for distribution by the airflow created by the ceiling fan.

41. A heating, reheating and air purifying device for heating and purifying drawn air to create a heated airflow for mixing with the upward airflow created by an independently mounted ceiling fan, said heating and reheating device comprising in combination:

a) means for producing a primary heated airflow; and b) means for introducing said primary heated airflow into the secondary upward airflow created by the ceiling fan.

42. The heating, reheating and air purifying device as set forth in claim 41, wherein said means for producing a primary heated airflow comprises in combination:

a) at least one support means;

b) at least one inlet for introducing air to be heated;

c) at least one motor having at least one fan blade adapted for creating an airflow;

d) at least one heating element for heating said airflow of sufficient temperature to destroy airborne contaminants; and e) at least one outlet for introducing said heated airflow into said secondary upward airflow created by the ceiling fan.

43. The heating, reheating and air purifying device as set forth in claim 41 further comprising means for regulating the amount of heat introduced into said secondary upward airflow created by the ceiling fan.

44. A heating, reheating and air purifying device for heating a room and purifying the air, mounted independently of and designed to work in association with a ceiling fan, wherein the heating, reheating and air purifying device draws air from an upward location, filters said air and passes said air through heating elements of sufficient temperature to kill airborne contaminants, said heating device comprising in combination:

a) at least one support means;

b) at least one motor with at least one adapted fan blade for drawing air to be heated and creating an airflow;

c) at least one inlet for introducing air to be heated;

d) at least one filter element to filter said drawn air;

e) at least one heating element for heating and purifying said drawn air to yield a heated airflow;

f) means for selectively regulating said at least one heating element, wherein said means for selectively regulating is responsive to at least one input for regulating the temperature of said heated airflow to be mixed for distribution by the airflow created by the ceiling fan; and g) at least one outlet for exhausting said heated airflow.

45. The heating, reheating and air purifying device as set forth in claim 44 wherein said means for selectively regulating said at least one heating element is adjustable to maintain a desired temperature within a room.

46. The heating, reheating and air purifying device as set forth in claim 44 wherein said means for selectively regulating said at least one heating element is manually adjustable to set a desired temperature and then automatically regulates the heat produced to maintain said desired temperature.

47. A ceiling mounted heating device for supporting a ceiling fan, wherein said ceiling mounted heating device introduces a heated airflow into the circulative airflow created by the ceiling fan, said ceiling mounted heating device comprising in combination:

a) means for support from an upward location;

b) means for supporting the ceiling fan;

c) means for providing standard electrical power;

d) means for producing a primary heated airflow;

e) means for selectively regulating said means for producing said primary heated airflow, wherein said means for selectively regulating is responsive to at least one input for regulating the temperature of said primary heated airflow; and f) means for introducing said primary heated airflow into the circulative airflow created by the ceiling fan.

48. The ceiling mounted heating device as set forth in claim 47, wherein said means for producing said primary heated airflow comprises in combination:

a) at least one motor having at least one fan blade adapted for creating an airflow; and b) at least one heating element for heating said airflow.

49. The ceiling mounted heating device as set forth in claim 47, wherein said means for introducing said primary heated airflow comprises in combination:

a) at least one inlet for introducing air to be heated; and b) at least one outlet for exhausting said primary heated airflow.

50. The ceiling mounted heating device as set forth in claim 48 further comprising a heat sink material for reducing the transfer of heat between said at least one heating element and proximate elements.

51. The ceiling mounted heating as set forth in claim 47 wherein said means for selectively regulating said means for producing said primary heated airflow is adjustable to regulate the amount of heat introduced into the circulative airflow created by the ceiling fan.

52. A heating device mounted independently of and designed to work in association with a distribution fan, to heat a room, said heating device comprising in combination:

a) means for producing a heated airflow; and b) means for introducing said heated airflow into the airflow created by the distribution fan.

53. The heating device as set forth in claim 52 wherein said means for producing a heated airflow comprises in combination:

a) at least one support means for supporting said heating device;

b) at least one motor having at least one fan blade adapted for creating an airflow;

c) at least one heating element for heating said airflow; and d) at least one inlet for introducing air to said at least one heating element.

54. The heating device as set forth in claim 52 wherein said means for introducing said heated airflow comprises in combination:

a) at least one inlet for introducing air to be heated;

b) at least one outlet for exhausting said heated airflow; and c) a mounting location that places said outlet proximal to the airflow created by the distribution fan.

55. The heating device as set forth in claim 53 further comprising a heat sink material for reducing the transfer of heat between said at least one heating element and proximate elements.

56. A heating device mounted independently of and becoming a recirculating system when working in association with a distribution fan to heat a room, comprising in combination:

a) at least one attachment means for attaching said heating device to an upward location;

b) at least one motor having at least one fan blade for creating a primary airflow; and c) at least one heating element for heating said primary airflow.

57. The heating device as set forth in claim 56 wherein said primary heated airflow mixes with the airflow created by the distribution fan to heat and reheat a room.

58. The heating device as set forth in claim 56 having at least one inlet for introducing air to be heated.

59. The heating device as set forth in claim 56 having at least one outlet for exhausting said heated primary airflow.

60. A heating and reheating device for heating a room mounted independently of and designed to work in association with a distribution fan, said heating and reheating device comprising in combination:

a) at least one support;

b) means for discharging a heated primary airflow from said device;

c) means for regulating the amount of heat created by said device.

61. The heating and reheating device as set forth in claim 60 wherein said heating and reheating device is mounted separately from the distribution fan.

62. The heating and reheating device as set forth in claim 60 wherein said heating and reheating device is adapted to removably receive and mount the distribution fan.

63. The heating and reheating device as set forth in claim 60 wherein said means for discharging heat comprises:

a) an inlet for introducing air to be heated;

b) at least one motorized fan for generating an airflow;

c) at least one heating element for heating said airflow; and d) at least one outlet for discharging said heated airflow.

64. The heating and reheating device as set forth in claim 60 wherein said means for regulating is adjustable to maintain a desired temperature within the room.

65. The heating and reheating device as set forth in claim 60 wherein said means for regulating is manually adjustable to set a desired temperature and then automatically regulates the heat produced to maintain said desired temperature.

66. A heating and recirculating system that comprises an independently mounted heating module designed to work in association with a distribution fan operating to push air in an upward direction to create a near uniform heated temperature throughout a room, said heating and recirculating system comprising in combination;

a) at least one means for supporting said heating and recirculating system;

b) at least one heating module comprising;

i. at least one inlet for introducing air to be heated;

ii. at least one motorized fan for creating an airflow;

iii. at least one heating element for heating said airflow and creating a heated airflow; and iv. at least one outlet for exhausting said heated airflow; wherein the distribution fan is placed proximal to said heating and recirculating system.

67. The heating and recirculating system as set forth in claim 66 wherein the heated airflow produced by said heating module mixes immediately with the upward airflow created by the distribution fan for near uniform distribution throughout the room.

68. A heating device mounted to an upward location, adapted for receiving, supporting and working in association with a distribution fan to heat a room, said heating device comprising in combination:

a) at least one support means;

b) at least one heating module with means for mounting and supporting the distribution fan comprising:

i. an inlet for introducing air to be heated;

ii. at least on motor with at least one attached fan blade for drawing air through said inlet and creating an airflow to be heated;

iii. at least one heating element for heating said airflow and creating a heated airflow; and iv. at least one outlet for exhausting said heated airflow to be mixed for distribution with the airflow created by the distribution fan;

c) means for selectively regulating said at least one heating element, wherein said means for selectively regulating is responsive to at least one input for regulating the temperature of said heated airflow to be mixed for distribution by the airflow created by the distribution fan; and d) at least one heat barrier for reducing the transfer of heat between said at least one heating element and proximate elements.

69. The heating device as set forth in claim 68 wherein said means for mounting and supporting a distribution fan comprises a receiving aperture and means for securing the distribution fan within said receiving aperture.

70. The heating device as set forth in claim 68 wherein said means for selectively regulating said at least one heating element is manually adjustable to set a desired temperature and then automatically regulates the heat produced to maintain said desired temperature.

71. A heating device mounted independently of and with no physical interface to a distribution fan, said heating device designed to functionally associate with the airflow created by the distribution fan, said heating device comprising in combination:

a) at least one support means; and b) at least one heating module for creating a heated airflow mounted proximate the upward flow of air created by the distribution fan.

72. The heating device as set forth in claim 71 wherein the heating module is located above and within the horizontal circumference of the immediate airflow of the distribution fan.

73. The heating device as set forth in claim 71 wherein said heated airflow immediately mixes with the upward flow of air created by a distribution fan for distribution throughout the room.

74. A heating device mounted to the support means of a distribution fan and designed to work in association with a distribution fan to heat a room, said device comprising in combination:

a) at least one attachment means;

b) at least one heating module comprising:

i. at least one motorized fan for creating an airflow to be heated; and ii. at least one heating element for heating said airflow to create a heated airflow for mixing with the airflow created by the distribution fan, said at least one heating element isolated from the distribution fan.

75. The heating device as set forth in claim 74 wherein the attachment means is located upwards of a distribution fan, mounted on the support means that supports the distribution fan.

76. The heating device as set forth in claim 74 wherein said at least one heating module is regulated manually to adjust the amount of heat created by said at least one heating element to create a desired room temperature.

77. The heating device as set forth in claim 74 having at least one inlet for introducing air to be heated.

78. The heating device as set forth in claim 74 having at least one outlet for exhausting the heated airflow for mixing with the airflow created by the distribution fan.

79. A heating system having one or more heating devices, independently mounted of and working in association with a distribution fan to mix heated airflow with the circulatory airflow of the distribution fan to heat a room, comprising in combination:

a) means for supporting said heating system;

b) at least one inlet for introducing air to be heated within said heating system;

c) at least one motorized fan for creating an airflow to be heated;

d) at least one heating element for heating said airflow; and e) at least one outlet for exhausting said heated airflow into the path of an upward flow of air created by the distribution fan.

80. The heating system as set forth in claim 79 wherein said means for support is independent and separate of any support means associated with the distribution fan.

81. The heating system as set forth in claim 79 further comprising separate and independent controls for the distribution fan and for said heating device.

82. The heating system as set forth in claim 79 further comprising a dual control for actuating the distribution fan and said heating device.

83. A method for heating a room with a heating device mounted independently of and working in association with a distribution fan, comprising the steps of:

a) moving air through at least one inlet of a heating module, induced by the rotation of at least one motor and at least one fan blade, then urging said air through at least one heating element for heating the created airflow; and b) mixing said created heated airflow with the upward flow of air from a distribution fan for near uniform distribution throughout a room.

84. A heating device for heating a room, said heating device designed to work in association with a distribution fan having blades, wherein the distribution fan produces a secondary airflow, said heating device comprising in combination:

a) at least one support means that positions said heating device upwards of the distribution fan and within the circumferential area produced by the outside radius of the distribution fan blades;

b) means for producing a primary heated airflow to be circulated by the blades of the distribution fan;

c) means for selectively regulating said means for producing said primary heated airflow, wherein said means for selectively regulating is responsive to at least one input for regulating the temperature of said primary heated airflow; and d) means for introducing said primary heated airflow into the secondary airflow created by the distribution fan.

85. The heating device as set forth in claim 84, wherein said means for producing said primary heated airflow comprises in combination:

a) at least one inlet for introducing air to be heated;

b) at least one motor with at least one adapted fan blade for drawing air through said at least one inlet;

c) at least one heating element for heating said introduced air; and d) at least one outlet for exhausting said heated airflow for distribution by the distribution fan.

86. The heating device as set forth in claim 85 further comprising a heat shield material for reducing the transfer of heat between said at least one heating element and proximate elements.

87. The heating device as set forth in claim 84 wherein said means for selectively regulating said means for producing said primary heated airflow is adjustable to maintain a desired temperature within the room.

88. The heating device as set forth in claim 84 wherein said means for selectively regulating said means for producing said primary heated airflow of heat is manually adjustable to set a desired temperature and then automatically regulates the heat produced to maintain said desired temperature.

89. A heating and reheating device for heating a room mounted independently of and becoming a recirculating system when working in association with a distribution fan, wherein the distribution fan produces a secondary airflow, said heating device comprising in combination:

a) at least one means for attaching said heating device to an upward location;

b) at least one motor having at least one fan blade for creating a primary airflow;

c) at least one inlet for introducing air to be heated;

d) a plurality of heating elements arranged in a tandem configuration to first heat the incoming air and then reheat said heated air to produce higher air temperature; and e) at least one outlet for exhausting said heated airflow into the path of the airflow created by the distribution fan.

90. The heating and reheating device as set forth in claim 89 wherein the heated airflow produced by said heating module mixes with the upward airflow created by the distribution fan for near uniform distribution throughout the room.

91. The heating and reheating device as set forth in claim 89 having a means for regulating the amount of heated airflow to be mixed for distribution by the airflow created by the distribution fan.

92. A heating, reheating and air purifying device for heating and purifying drawn air to create a heated airflow for mixing with the upward airflow created by an independently mounted distribution fan, said heating and reheating device comprising in combination:

a) means for producing a primary heated airflow;

b) means for introducing said primary heated airflow into the secondary upward airflow created by the distribution fan; and c) means for isolating said means for producing said primary heated airflow from the distribution fan.

93. The heating, reheating and air purifying device as set forth in claim 92, wherein said means for producing said primary heated airflow comprises in combination:

a) at least one support means;

b) at least one inlet for introducing air to be heated;

c) at least one motor having at least one fan blade adapted for creating an airflow;

d) at least one heating element for heating said airflow of sufficient temperature to destroy airborne contaminants; and e) at least one outlet for introducing said heated airflow into said secondary upward airflow created by the distribution fan.

94. The heating, reheating and air purifying device as set forth in claim 92 having a means for regulating the amount of heat introduced into said secondary upward airflow created by the distribution fan.

95. A heating, reheating and air purifying device for heating a room and purifying the air, mounted independently of and designed to work in association with a distribution fan, wherein the heating, reheating and air purifying device draws air from an upward location, filters said air and passes said air through heating elements of sufficient temperature to kill airborne contaminants, said heating device comprising in combination:

a) at least one support means;

b) at least one motor with at least one adapted fan blade for drawing air to be heated and creating an airflow;

c) at least one inlet for introducing air to be heated;

d) at least one filter element to filter said drawn air;

e) at least one heating element for heating and purifying said drawn air;

f) means for regulating the amount of heated airflow to be mixed for distribution by the airflow created by the distribution fan; and g) at least one outlet for exhausting said heated airflow.

96. The heating, reheating and air purifying device as set forth in claim 95 wherein said means for regulating the amount of heated airflow is adjustable to maintain a desired temperature within a room.

97. The heating, reheating and air purifying device as set forth in claim 95 wherein said means for regulating the amount of heated airflow is manually adjustable to set a desired temperature and then automatically regulates the heat produced to maintain said desired temperature.

98. A ceiling mounted heating device for supporting a distribution fan, wherein said ceiling mounted heating device introduces a heated airflow into the circulative airflow created by the distribution fan, said ceiling mounted heating device comprising in combination:

a) means for support from an upward location;

b) means for supporting the distribution fan and providing standard electrical power;

c) means for producing a primary heated airflow;

d) means for selectively regulating said means for producing said primary heated airflow, wherein said means for selectively regulating is responsive to at least one input for regulating the temperature of said primary heated airflow; and e) means for introducing said primary heated airflow into the circulative airflow created by the distribution fan.

99. The ceiling mounted heating device as set forth in claim 98, wherein said means for producing said primary heated airflow comprises in combination:

a) at least one motor having at least one fan blade adapted for creating an airflow; and b) at least one heating element for heating said airflow.

100. The ceiling mounted heating device as set forth in claim 99 further comprising a heat sink material for reducing the transfer of heat between said at least one heating element and proximate elements.

101. The ceiling mounted heating device as set forth in claim 98, wherein said means for introducing said primary heated airflow comprises in combination:

a) at least one inlet for introducing air to be heated; and b) at least one outlet for exhausting said primary heated airflow.

102. The ceiling mounted heating device as set forth in claim 98 wherein said means for selectively regulating said means for producing said primary heated airflow is adjustable to regulate the amount of heat introduced into the circulative airflow.

* * * * *